US011118340B2

(12) United States Patent
Huber

(10) Patent No.: US 11,118,340 B2
(45) **Date of Patent: *Sep. 14, 2021**

(54) METHOD OF LEVELING AN ADJUSTABLE FLOOR DRAIN APPARATUS

(71) Applicant: The Drain Company, LLC, Tacoma, WA (US)

(72) Inventor: Donald G. Huber, Tacoma, WA (US)

(73) Assignee: THE DRAIN COMPANY, LLC, Tacoma, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/503,030

(22) Filed: Jul. 3, 2019

(65) Prior Publication Data

US 2020/0165807 A1 May 28, 2020

Related U.S. Application Data

(63) Continuation of application No. 15/593,858, filed on May 12, 2017, now Pat. No. 10,378,196, which is a continuation-in-part of application No. 15/403,975, filed on Jan. 11, 2017, now Pat. No. 10,370,841, which is a continuation-in-part of application No.

(Continued)

(51) Int. Cl.
*E03F 5/04* (2006.01)
*E03F 5/06* (2006.01)

(52) U.S. Cl.
CPC ..... *E03F 5/0407* (2013.01); *E03F 5/06* (2013.01); *E03F 2005/0413* (2013.01); *E03F 2005/0414* (2013.01)

(58) Field of Classification Search
CPC ..... E03F 5/0407; E03F 2005/0414; E03F 2005/0413; E03F 5/06; E03F 2005/063
USPC ..... 210/164, 166; 52/302.1
See application file for complete search history.

(56) References Cited

U.S. PATENT DOCUMENTS 1,766,621 A 6/1930 Fleming
1,792,345 A 2/1931 Williams
2,190,532 A 2/1940 Lukomski
(Continued)

FOREIGN PATENT DOCUMENTS

CA 2686031 A1 5/2011
CA 2952977 A1 1/2016
(Continued)

OTHER PUBLICATIONS

International Search Report and Written Opinion dated Oct. 1, 2015 in PCT/US2015/039807.

*Primary Examiner* — Michael Safavi
(74) *Attorney, Agent, or Firm* — Knobbe, Martens, Olson & Bear, LLP

(57) ABSTRACT

An adjustable floor drain apparatus includes a housing configured for positioning adjacent a drain pipe, manhole riser, or other feature, a leveling frame configured to be positioned at least partially above the housing, a grate configured to be positioned at least partially above the leveling frame and secured to the leveling frame, and a leveling member. The leveling member can be configured such that actuating the leveling member adjusts the position of the grate relative to the housing while the leveling member remains fixed relative to the housing. The leveling member can be configured such that actuating the leveling member moves the leveling member relative to the grate and adjusts the position of the grate relative to the housing.

10 Claims, 24 Drawing Sheets

Related U.S. Application Data

14/795,407, filed on Jul. 9, 2015, now Pat. No. 10,370,840.

(60) Provisional application No. 62/023,685, filed on Jul. 11, 2014.

(56) References Cited

U.S. PATENT DOCUMENTS

| | | | |
|---|---|---|---|
| 2,490,075 | A | 12/1949 | Matheis |
| 2,626,674 | A | 1/1953 | Boosey |
| 2,629,457 | A | 2/1953 | Baker |
| 2,749,999 | A | 6/1956 | Schmid |
| 2,783,852 | A | 3/1957 | Sisk |
| 2,859,452 | A | 11/1958 | Seewack |
| 2,889,928 | A | 6/1959 | Sisk |
| 3,228,083 | A | 1/1966 | Gardner et al. |
| 3,246,582 | A | 4/1966 | Wade et al. |
| 4,067,072 | A | 1/1978 | Izzi |
| 4,092,745 | A | 6/1978 | Oropallo |
| 4,146,939 | A | 4/1979 | Izzi |
| 4,402,625 | A | 9/1983 | Rechkin |
| 4,505,814 | A | 3/1985 | Marshall |
| 4,694,513 | A | 9/1987 | Kiziah |
| 4,871,451 | A | 10/1989 | Piskula |
| 4,879,771 | A | 11/1989 | Piskula |
| 4,883,590 | A | 11/1989 | Papp |
| 5,022,430 | A | 6/1991 | Degooyer |
| 6,179,518 | B1 | 1/2001 | Suatac |
| 6,269,495 | B1 | 8/2001 | Sondrup |
| 6,350,373 | B1 | 2/2002 | Sondrup |
| 6,381,775 | B1 | 5/2002 | Sondrup |
| 6,687,825 | B1 | 2/2004 | Challener et al. |
| 6,687,925 | B2 | 2/2004 | Minnick |
| 6,766,545 | B2 | 7/2004 | Hodges |
| 7,658,043 | B2 | 2/2010 | Wroblewski |
| 7,735,512 | B1 | 6/2010 | Ismert et al. |
| 7,964,095 | B1 | 6/2011 | Graybeal |
| 8,347,424 | B2 | 1/2013 | Wroblewski et al. |
| 8,347,906 | B1 | 1/2013 | Ismert et al. |
| 8,658,033 | B2 | 2/2014 | Farkas |
| 8,881,490 | B2 | 11/2014 | Wroblewski et al. |
| 9,453,331 | B1 | 9/2016 | Buffington |
| 9,834,894 | B1 | 12/2017 | Reed et al. |
| 2002/0148039 | A1 | 10/2002 | Minnick |
| 2003/0159211 | A1 | 8/2003 | Hodges |
| 2009/0223884 | A1 | 9/2009 | Wroblewski et al. |
| 2011/0168711 | A1 | 7/2011 | Coscarella |
| 2011/0173747 | A1 | 7/2011 | Evans et al. |
| 2012/0025517 | A1 | 2/2012 | Majocka et al. |
| 2014/0020174 | A1 | 1/2014 | Evans et al. |
| 2014/0157514 | A1 | 6/2014 | Cook |
| 2016/0010320 | A1 | 1/2016 | Huber |
| 2017/0159278 | A1 | 6/2017 | Huber |
| 2017/0247872 | A1 | 8/2017 | Huber |

FOREIGN PATENT DOCUMENTS

| | | | |
|---|---|---|---|
| CA | 2997150 | A1 | 11/2018 |
| CN | 203307900 | | 11/2013 |
| DE | 9400242 | U1 | 3/1994 |
| DE | 9421582 | U1 | 3/1996 |
| WO | WO 2016/007787 | | 1/2016 |

METHOD OF LEVELING AN ADJUSTABLE FLOOR DRAIN APPARATUS

INCORPORATION BY REFERENCE TO ANY PRIORITY APPLICATIONS

Any and all applications for which a foreign or domestic priority claim is identified in the Application Data Sheet as filed with the present application, are hereby incorporated by reference in their entirety under 37 CFR 1.57. This application is a continuation of U.S. application Ser. No. 15/593,858, filed May 12, 2017, and entitled "DRAIN AND DRAIN LEVELING MECHANISM," which is a continuation in part of U.S. application Ser. No. 15/403,975, filed Jan. 11, 2017, and entitled "DRAIN AND DRAIN LEVELING MECHANISM," which is a continuation in part of U.S. application Ser. No. 14/795,407, filed on Jul. 9, 2015, and entitled "DRAIN AND DRAIN LEVELING MECHANISM," which claims the benefit of priority under 35 U.S.C. § 119(e) of U.S. Provisional Application No. 62/023,685, filed on Jul. 11, 2014, and entitled "DRAIN AND DRAIN LEVELING MECHANISM," the entire disclosure of each of which is incorporated herein by reference.

BACKGROUND

Field of the Disclosure

The present disclosure relates in general to adjustable drains. Such drains can be used in buildings, floors, basements, exterior areas or other areas that require drainage, as well as for urinals and other waste handling devices connected to a sewer or drain conduit. Such drains can also be used for clean outs.

Description of the Related Art

Many varieties of adjustable drains exist, employing a variety of adjustment mechanisms. However, such devices and certain components thereof have various limitations and disadvantages.

SUMMARY OF THE DISCLOSURE

Various embodiments described herein relate to floor drains that can be used to funnel liquids from a surface, such as a floor, and into a drain pipe. Floor drains typically have a grate or plate that allows fluids to flow through the drain and into the drain pipe, but that prevent larger solid objects from entering the floor drain. Floor drains are typically installed around a drain pipe when a floor surface is being prepared. As used herein, the term "floor" is understood to mean any surface that may accumulate fluids to be drained. Thus, it may include elevated surfaces such as ledges in addition to standard flooring.

It is often desirable for a floor drain to be relatively flush with the level of the floor, thereby preventing accidental injuries from objects catching on a lip of the drain or the floor or other inconveniences associated with a floor drain that rises above or is set below the level of the floor. In many instances, modifications to a floor, such as adding, modifying, or removing a floor surface, may adjust the height of the floor. Additionally, a floor may not always be completely level relative to the drain pipe. In these instances, it can be desirable to provide a floor drain that can be adjusted in height and/or angle. Such a floor drain can be adjusted to help ensure that the plate remains generally level with the floor. Additionally, in various embodiments it can be desirable for an adjustable floor drain to be easily and quickly adjustable with minimal steps.

Various embodiments described herein present the advantage of allowing for adjustment of the height and/or angle of a floor drain grate without having to remove the grate from an adjustable drain apparatus. This can increase the ease and efficiency of adjusting the floor drain.

Various embodiments described herein provide additional features to improve the ease and efficiency of adjusting a floor drain apparatus. In some embodiments, a floor drain assembly or apparatus can include a leveling member that can be used to adjust the height and/or angle of a grate and that can simultaneously be used to attach different components of the floor drain assembly to each other. As a result, in some embodiments adjusting the height and/or angle of the grate requires the manipulation of no more than 3 screws.

In various embodiments, an adjustable floor drain apparatus can include a cylindrical collar comprising a threaded outer surface and an inward projection lip, the collar configured to be positioned at least partially around a drain pipe with the lip positioned over an end of the drain pipe. The apparatus can also include a cylindrical housing comprising a threaded inner surface configured to engage the threaded outer surface of the collar, the housing further comprising a plurality of receiving shafts, each receiving shaft having a bottom, an open top, and an open outer wall. The apparatus can include a plurality of plates, each plate positioned within a receiving shaft and offset from the bottom of the shaft, each plate comprising a channel, and a leveling frame comprising a ring and a plurality of locking blocks extending below the ring, each of the plurality of locking blocks configured to be positioned within a corresponding receiving shaft of the housing and comprising a threaded vertical bore. The apparatus can include a plurality of leveling screws, each of the at least three leveling screws comprising a head at a first end and a threaded shaft with a tool receiving cutout at a second end, each of the at least three leveling screws configured to be positioned in a respective receiving shaft of the plurality of receiving shafts with the head between a respective plate of the plurality of plates and the bottom of the respective receiving shaft, and with the shaft threadably engaged within the threaded vertical bore of the locking block positioned within the respective receiving shaft. The apparatus can also include a grate securable to the frame, the grate comprising a plurality of openings, each of the plurality of openings to be aligned with the threaded bore of a respective one of the plurality of locking blocks.

In various embodiments, an adjustable floor drain apparatus can include a cylindrical collar comprising a threaded outer surface and an inward projection lip, the collar configured to be positioned at least partially around a drain pipe with the lip positioned over an end of the drain pipe. The apparatus can also include a cylindrical housing comprising a threaded inner surface configured to engage the threaded outer surface of the collar, the housing further comprising a circumferential channel having an open top, an outer side wall, an inner side wall, and a bottom. The apparatus can include at least three plates positioned within the circumferential channel and offset from the bottom of the channel, each plate positioned adjacent an opening in the inner side wall of the circular channel and having a cutout. The apparatus can include a leveling frame comprising a ring, a fin projecting downward from the ring along a circumference of the ring, and at least three locking blocks extending radially inward from the fin, each of the at least three locking blocks comprising a threaded vertical bore configured to be aligned with a cutout of one of the at least three plates. The apparatus can also include at least three leveling screws, each of the at least three leveling screws comprising a head at a first end and a threaded shaft with a tool receiving cutout at a second end, each of the at least three leveling screws configured to be positioned with the head between a respective plate of the at least three plates and the bottom of the circumferential channel, and with the shaft threadably engaged within the threaded vertical bore of the locking block aligned with the respective plate of the at least three plates. The apparatus can also include a grate securable to the frame, the grate comprising a plurality of openings, with an opening configured to be aligned with each of the at least three locking blocks of the leveling frame.

In various embodiments, an adjustable floor drain apparatus can include a housing configured for positioning adjacent a drain pipe, a leveling frame configured to be positioned at least partially above the housing, a grate configured to be positioned at least partially above the leveling frame and secured to the leveling frame, and a leveling member, wherein the leveling member is configurable such that actuating the leveling member adjusts the position of the grate relative to the housing while the leveling member remains fixed relative to the housing.

In various embodiments, an adjustable floor drain apparatus can include a housing configured for positioning adjacent a drain pipe, a frame configured to be positioned adjacent the housing, a grate configured to be positioned at least partially above the frame, and a leveling member configured for attachment to the frame, wherein actuating the leveling member moves the leveling member relative to the grate and adjusts the position of the grate relative to the housing.

In various embodiments, a method of operating an adjustable floor drain apparatus to adjust a height of a grate of the floor drain apparatus relative to a housing of the floor drain apparatus can include providing a floor drain apparatus comprising a housing positioned adjacent a drain pipe, a leveling frame positioned at least partially above the housing and attached to the housing, a grate positioned at least partially above the leveling frame and secured to the leveling frame, and a first leveling member, a second leveling member, and a third leveling member. The method can also include actuating first leveling member, actuating the second leveling member, and actuating the third leveling member, wherein the first leveling member, second leveling member, and third leveling member are actuated while the housing is fixed relative to the leveling frame.

In various embodiments, a method of operating an adjustable floor drain apparatus to adjust a height of a grate of the floor drain apparatus relative to a housing of the floor drain apparatus can include providing a floor drain apparatus comprising a housing positioned adjacent a drain pipe, a leveling frame positioned at least partially above the housing, a grate positioned at least partially above the leveling frame and secured to the leveling frame, and a first leveling member, a second leveling member, and a third leveling member. The method can include actuating first leveling member, actuating the second leveling member, and actuating the third leveling member, wherein the first leveling member, second leveling member, and third leveling member are actuated while the grate is attached to the leveling frame.

In various embodiments, an adjustable floor drain apparatus is described. The adjustable floor drain apparatus comprises a collar, a housing, a plurality of plates, a leveling frame, a plurality of leveling members and a grate. The collar extends circumferentially about an axis and is configured to couple with a drain pipe. The housing extends circumferentially about the axis and comprises therein a plurality of receiving areas, each receiving area having a bottom, with the housing configured to couple with the collar. Each plate of the plurality of plates is configured to be secured within one of the plurality of receiving areas axially offset from the bottom, with each plate comprising a channel therethrough having a first width. The leveling frame comprises a ring extending circumferentially about the axis and a plurality of locking blocks extending downward from the ring, with each of the plurality of locking blocks comprising a vertical bore configured to align with a corresponding bottom of the housing, and the vertical bore at least partially threaded. Each of the plurality of leveling members comprises a shaft having a head at a first end and a tool receiving portion at a second end. The shaft is at least partially threaded, with the head including an end portion having a second width greater than the first width, and each shaft of the leveling members is configured to threadingly engage the threads of the vertical bore of the respective locking block with the end portion positioned between the bottom and the plate to axially secure the leveling member within the receiving area. The grate is securable to the leveling frame and comprises a plurality of openings, with each of the plurality of openings configured to be aligned with the threaded bore of a respective one of the plurality of locking blocks.

In some embodiments, rotation of the leveling members may adjust the leveling frame and thereby the grate relative to the housing and the leveling members may remain axially stationary relative to the housing. The adjustable floor drain apparatus may further comprise an outer and an inner wall of the housing extending circumferentially about the axis and defining a circumferential housing channel therein, and a fin extending circumferentially and downward from the ring, where the housing channel is configured to receive the fin therein. The housing channel may be wider than the fin such that the fin can be angled within the channel. The plurality of receiving areas may be at least three receiving areas, the plurality of plates may be at least three plates, the plurality of locking blocks may be at least three locking blocks, the plurality of leveling members may be at least three leveling members, and the plurality of openings in the grate may be at least three openings. The housing may comprise an upper wall having a first diameter, a lower wall having a second diameter smaller than the first diameter, and an angled segment extending upward and outward from the lower wall to the upper wall, wherein the lower wall is configured to couple with the collar. The housing may comprise external threads, the collar may comprise internal threads, and the housing may be configured to couple with the collar by engaging the external threads of the housing with the internal threads of the collar. The housing may comprise internal threads, the collar may comprise external threads, and the housing may be configured to couple with the collar by engaging the internal threads of the housing with the external threads of the collar. Each of the plurality of receiving areas may have at least one rib coupling the bottom with the circumferential housing. Each of the plurality of receiving areas may have a wall extending upward from the bottom.

In various embodiments, an adjustable floor drain apparatus is described. The adjustable floor drain apparatus comprises a housing, a leveling frame, a grate and a leveling member. The housing defines an axis and is configured for positioning adjacent a drain pipe. The leveling frame is configured to be positioned at least partially above the housing and has a fin extending into a channel of the housing, and the leveling frame is moveable relative to the housing. The grate is configured to be positioned at least partially above the leveling frame and secured to the leveling frame. The leveling member is configured to couple with the frame and to be axially restrained by the housing, with an end of the leveling member accessible through the grate to be actuated, and where actuating the leveling member axially adjusts the position of at least a portion of the grate relative to the housing while the leveling member remains fixed relative to the housing.

In some embodiments, the adjustable floor drain apparatus further may comprise a collar configured to couple with the housing and the drain pipe. The leveling member may be a first leveling member and further comprise a second leveling member and a third leveling member, where the first leveling member, the second leveling member, and the third leveling members are the only leveling members. The leveling member may be a screw. The adjustable floor drain apparatus may further comprise a plurality of the leveling members configured for attachment to the frame, where actuating the plurality of leveling members adjusts a height of the grate relative to the housing. The frame may comprise a locking block with a central bore configured to receive the leveling member. The housing may comprise a receiving area configured to align with the locking block.

In various embodiments, a method of adjusting a floor drain apparatus is described. The method may comprise providing the floor drain apparatus. The apparatus may comprise a housing defining an axis and positioned adjacent a drain pipe, a leveling frame positioned at least partially above the housing and having a fin extending into a channel of the housing, with the leveling frame moveable relative to the housing, a grate positioned at least partially above the leveling frame and secured to the leveling frame, and a first, second and third leveling member coupled with the frame and axially restrained by the housing, with an end of each leveling member accessible through the grate to be actuated, and where actuating each leveling member adjusts the axial position of at least a portion of the grate relative to the housing while each leveling member remains axially fixed relative to the housing. The method may further comprise actuating the first leveling member, actuating the second leveling member and actuating the third leveling member.

In some embodiments, the method may further comprise coupling the housing with the drain pipe via a collar. The method may further comprise actuating the first, second and third leveling members different amounts to angle the grate relative to the axis.

BRIEF DESCRIPTION OF THE DRAWINGS

Elements in the figures have not necessarily been drawn to scale in order to enhance their clarity and improve understanding of these various elements and embodiments described herein. Furthermore, elements that are known to be common and well understood to those in the industry are not depicted in order to provide a clear view of the various embodiments described herein, thus the drawings are generalized in form in the interest of clarity and conciseness.

DETAILED DESCRIPTION

In the following discussion that addresses a number of embodiments and applications, reference is made to the accompanying drawings that form a part hereof, and in which is shown by way of illustration specific embodiments in which the embodiments described herein may be practiced. It is to be understood that other embodiments may be utilized and changes may be made without departing from the scope of the disclosure.

Various inventive features are described below that can each be used independently of one another or in combination with other features. However, any single inventive feature may not address all of the problems discussed above or only address one of the problems discussed above. Further, one or more of the problems discussed above may not be fully addressed by the features of each embodiment described below.

Figure 1A:
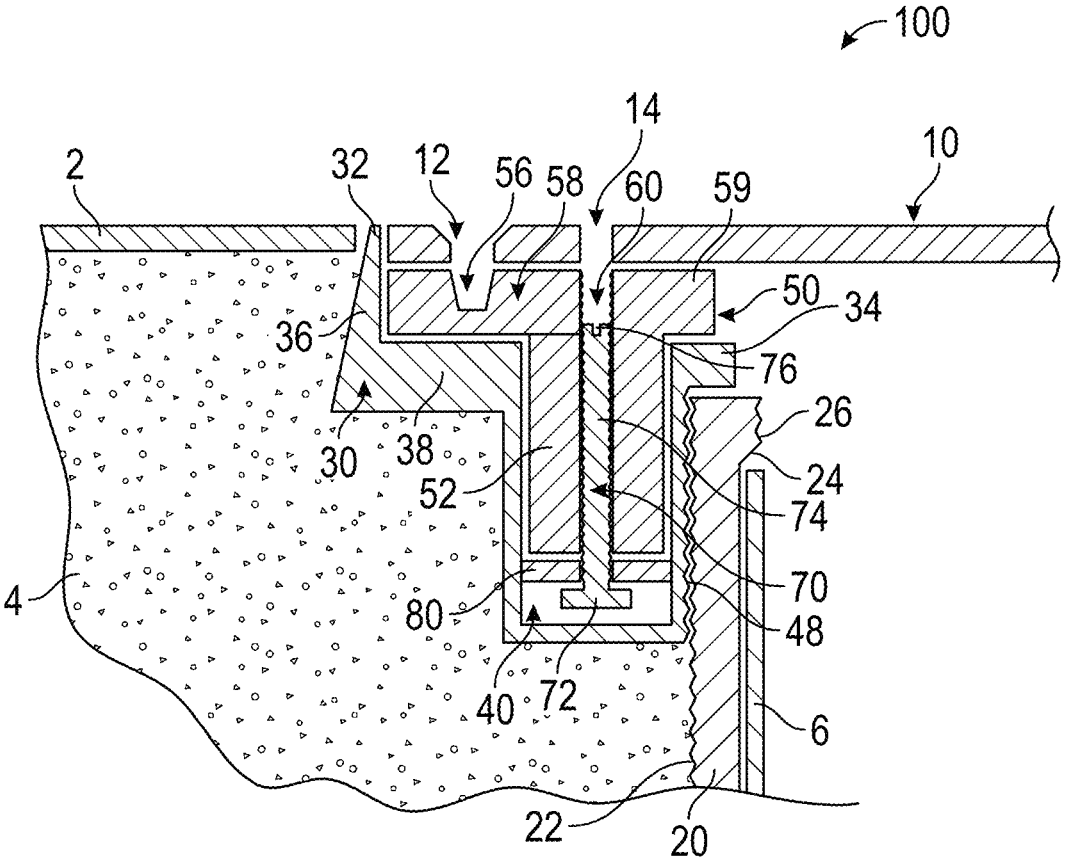
FIG. 1A illustrates one side of a cross section of one embodiment of an adjustable drain apparatus installed in a floor.
Figure 1B:
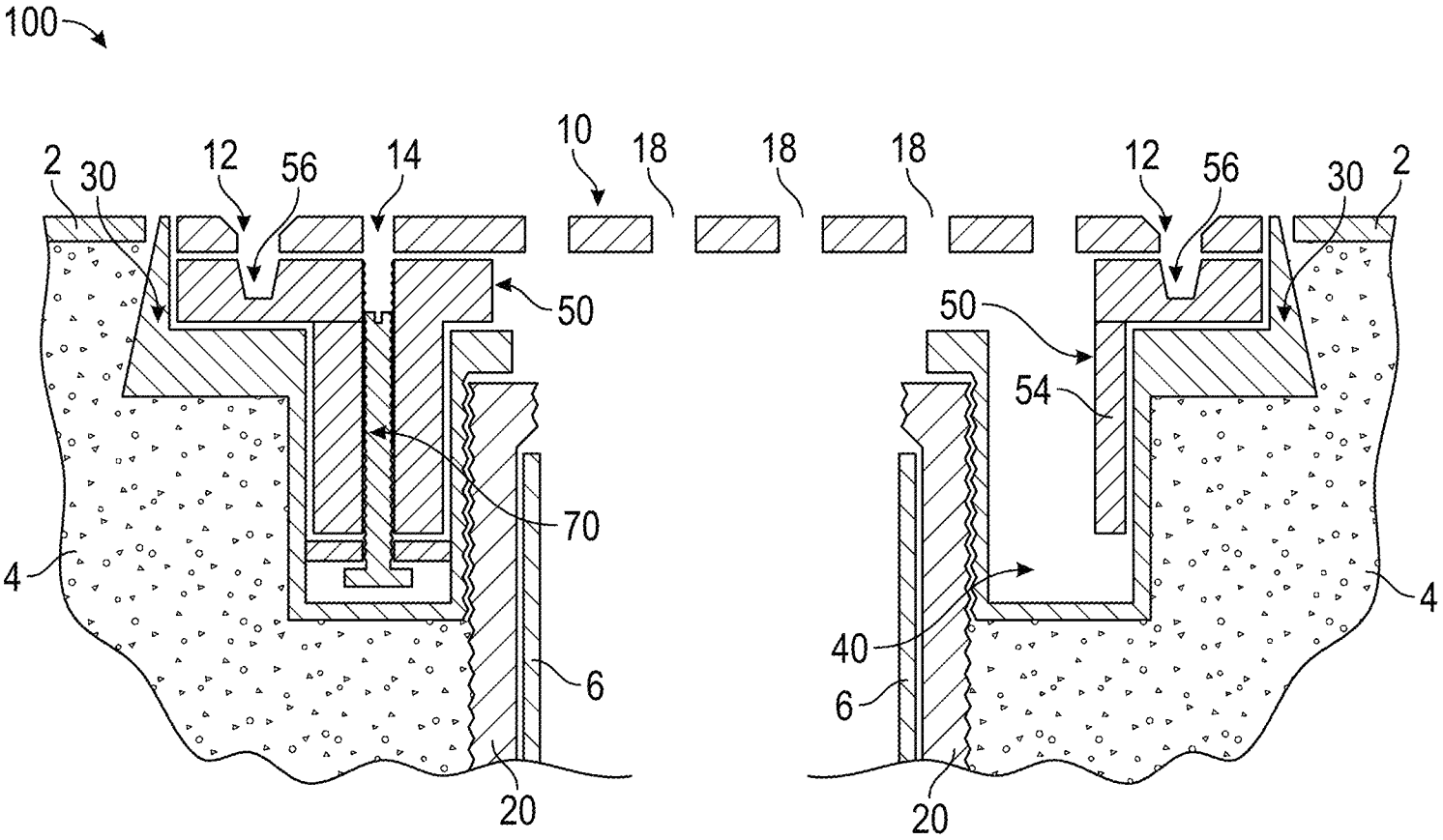
FIG. 1B illustrates a cross section of one embodiment of an adjustable drain apparatus installed in a floor.

FIG. 1A illustrates one embodiment of an adjustable floor drain assembly or apparatus 100. In some embodiments, the floor drain 100 can be a cylindrical structure configured to be positioned adjacent a drain pipe 6, such as surrounding the drain pipe 6. FIG. 1A illustrates one side of a cross section of the floor drain 100. FIG. 1B illustrates an entire cross section of one embodiment of a floor drain 100 positioned about a drain pipe 6. With reference to FIG. 1A, in some embodiments a floor drain apparatus 100 can include a cylindrical collar 20 that can be configured for positioning around the pipe 6. Preferably, the collar 20 can include a lip 24 that can be positioned about an end of the pipe 6. In some embodiments, the lip 24 can be angled, for example as illustrated, and in some embodiments the lip 24 can extend generally perpendicularly from the collar 20. In some embodiments, the collar 20 can have exterior threading 22 that can be configured to attach the collar 20 to other components of the drain 100.

In some embodiments, an interior of the collar 20 can be configured to receive a valve member. In some embodiments, the collar 20 can include internal threading 26 that can be used to attach the valve member to the collar 20.

In various embodiments, the adjustable drain apparatus 100 can include a cylindrical housing 30. In some embodiments, the housing 30 can include interior threads 48 that can be configured to mate with threading on the collar 20. In some embodiments, the housing can include an inner flange 34 that can be positioned over an upper end of the collar 20. As used herein, the terms "inner" and "outer" refer to radially inner and radially outer unless otherwise indicated. The inner flange 34 can help prevent screwing the housing 30 too far onto the collar 20. In some embodiments, a drain apparatus 100 may not include a collar 20, and the housing 30 can be positioned directly over the pipe 6, such as by having the flange 34 positioned over an end of the pipe 6.

A threaded relationship between the housing 30 and collar 20 can allow for adjusting the height of the housing 30 relative to the collar 20 and pipe 6. This adjustment is preferably done when installing the drain 100 in order to move the housing 30 to a desired height. For example, in some embodiments the housing 30 can be moved to a level approximately equal with the expected height of the floor. During installation, when the housing 30 has been placed at a desired height, concrete 4 can be placed to help provide a basis for the floor.

In some embodiments, the housing 30 can have an outer wall 36 that can extend to a top, or adjacent a top, of the adjustable drain apparatus 100. In some embodiments, the outer wall 36 can taper into an upper tip or edge 32. In some embodiments, the upper tip or edge 32 can be generally level with the surface of the floor 2. In some embodiments, once the housing 30 has been positioned relative to the pipe 6, concrete 4 can be placed to a height generally level with the tip or edge 32. In some embodiments, concrete can be poured to a height below the edge 32, such that a floor surface 2 placed above the concrete can be generally level with the tip or edge 32. In some embodiments, if the floor surface 2 is modified, not level, or otherwise varies from the height of the tip or edge 32, other components of the adjustable drain apparatus 100 can be moved to help level a grate 10 of the apparatus 100 with the floor 2.

In some embodiments, an adjustable drain apparatus 100 can include a leveling frame 50 that can be used to help adjust the height, angle, and/or other aspects of the grate 10. As used herein, references to adjusting the height of the grate 10 refer to adjustments that move a center of the grate 10 relative to a reference aspect of the adjustable drain apparatus 100 that does not move, such as the housing 30. Thus, angling the grate 10 about an axis that passes through the center of the grate 10 would not be considered an adjustment to the height of the grate 10, even though portions of the grate 10 may move up or down.

In some embodiments, the leveling frame 50 can be placed above the housing 30. In some embodiments, a portion of the leveling frame 50 can be positioned within a portion of the housing 30. For example, in some embodiments the housing 30 can include a channel 40 that can receive a portion of the leveling frame 50, such as a locking block 52. In some embodiments, the locking block 52 can include an internal flange 59 that can extend over a portion of the housing 30. This can help prevent fluid that enters the grate 10 from passing into the channel 40.

In some embodiments, the locking block 52 can include an actuation aperture 60 that can be configured to receive a leveling member 70, such as a leveling screw. In some embodiments, adjusting the leveling member 70 can adjust the position of the locking block 52 relative to the housing 30. In some embodiments, for example as illustrated, the leveling member 70 can also be used to attach the leveling frame 50 to the housing 30. This dual functionality of the leveling member 70 can remove the need for separate structures, such as screws, to attach the leveling frame 50 to the housing 30. Additionally, it can allow for adjusting the position of the locking block 52 relative to the housing 30 while the frame 50 remains rigidly attached to the housing 30. In other words, the leveling member 70 can secure the frame 50 to the housing 30 such that the only possible movement of the housing 30 relative to the locking block 52 and frame 50 is through actuating the leveling member 70.

In some embodiments, the leveling member 70 can include a shaft 74 and a head 72. The shaft 74 can include external threading that is configured to engage threading of the actuation aperture 60. The housing 30 can include a plate 80 or other blocking structure that can have an opening wide enough to allow the shaft 74 to pass through the opening but narrow enough to block the head 72 from passing through the opening. Thus, the plate 80 can help block movement of the leveling member 70 relative to the housing 30 such that the leveling member 70 can remain fixed relative to the housing 30. Consequently, when the leveling member 70 is positioned as illustrated in FIG. 1A, rotating the leveling member 70 can move the leveling frame 50 at the position of the leveling member 70 up or down relative to the housing 30, depending on the direction of rotation of the leveling member 70.

In some embodiments, the leveling member 70 can include a tool receiving portion 76 at a top end of the leveling member 70, which can be used to rotate the leveling member 70. In some embodiments, the tool receiving portion 76 can be a hexagonal socket, such that it can receive a hex key (e.g., an Allen wrench). Other configurations of the tool receiving portion 76 are considered, such that a variety of types of tools can be used to actuate the leveling member 70. For example, the tool receiving portion 76 can be configured as a slot to receive a flat head screw driver, as a cross-shape to receive a Philips head screw driver, etc. In some embodiments, a grate 10 positioned above the leveling frame 50 can include an opening 14 that can allow the tool to pass through the grate 10 and into the actuation aperture 60.

In various embodiments, a leveling frame 50 can include a plurality of locking blocks 52, each of which can correspond to a leveling member 70. If the leveling member 70 for each locking block 52 is adjusted the same amount, the height of the leveling frame 50 and grate 10 can increase or decrease accordingly. In contrast, actuating fewer than all of the leveling members 70, or actuating them different amounts or in different directions, will angle the leveling frame 50 and grate 10 by raising or lowering the side of the leveling frame 50 and the side of the grate 10 corresponding to each leveling member 70. Preferably, a leveling frame 50 includes at least three locking blocks 52, such that by adjusting the leveling members 70 a different amount at each locking block the plate 10 can be configured to reach any desired height in any desired angle within an available range.

Figure 8A:
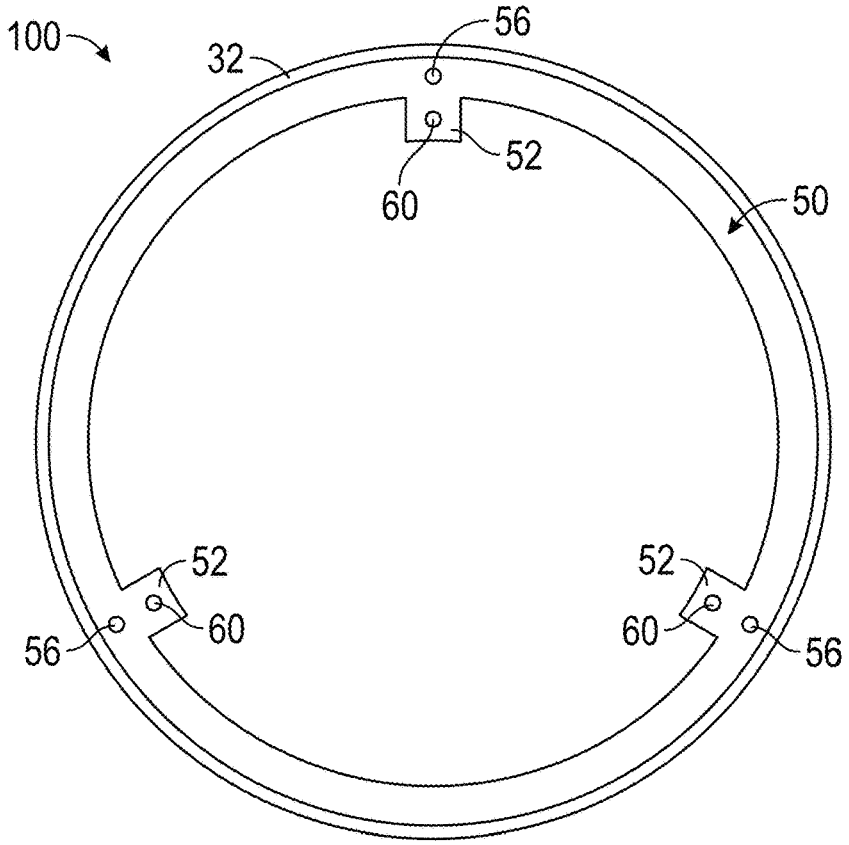
FIG. 8A is a top view of one embodiment of an adjustable drain apparatus, with a grate not shown.

In some embodiments, for example as shown in FIG. 8A, a leveling frame 50 can include three locking blocks 52 positioned evenly around a circumference of the leveling frame 50. In such embodiments, a cross section of an adjustable drain apparatus 100 may show a portion of the leveling frame 50 that includes a locking block 52 on one side of the drain pipe 6 and a portion of the leveling frame 50 without a locking block 52 on another side of the drain pipe 6. This is shown, for example, in FIG. 1B. In some embodiments, the locking blocks 52 may be directly across from each other, for example in embodiments of the leveling frame 50 having two or four locking blocks 52. In some embodiments, a portion of the leveling frame without a locking block 52 may include a fin 54 that extends into the housing channel 40.

With further reference to FIGS. 1A and 1B, in some embodiments a grate 10 can include an attachment opening 12 that can be configured to align with an attachment screw hole 56 in the leveling frame 50. The leveling frame 50 can include an outer ring or flange 58 with the attachment hole 56, which can be used to secure the leveling frame 50 to the grate 10. The outer ring or flange 58 can be integral with another feature or features of the leveling frame 50, for example integral with the locking block 52. In some embodiments, the hole 56 can be threaded and can be configured to receive a screw. In some embodiments, the attachment opening 12 can also be threaded to receive a screw. In some embodiments, the attachment opening 12 is not threaded. A screw or other locking mechanism can be inserted through these aligned holes and can be used to attach the grate 10 to the leveling frame 50. In some embodiments, the attachment opening 12 can have a counter bore, such as illustrated, thereby allowing a screw head to be flush with an upper surface of the grate 10. In some embodiments, for example as illustrated in FIG. 1B, the grate 10 can include a plurality of grate openings 18, which can be sized as desired to allow fluid to pass through the grate 10 and into the drain pipe 6 but prevent larger objects from passing through and into the drain pipe 6. In some embodiments, the grate 10 can include a plurality of the attachment openings 12 and/or screw holes 56. As shown in FIG. 1B for example, the plurality of attachment openings 12 and/or screw holes 56 may be located directly across from each other, such as 180 angular degrees apart. In some embodiments, the plurality of attachment openings 12 and/or screw holes 56 may not be located directly across from each other. For example, the plurality of attachment openings 12 and/or screw holes 56 may be located angularly approximately 60 degrees from each other, as shown and further described herein, for example with respect to FIG. 8A.

Figure 2:
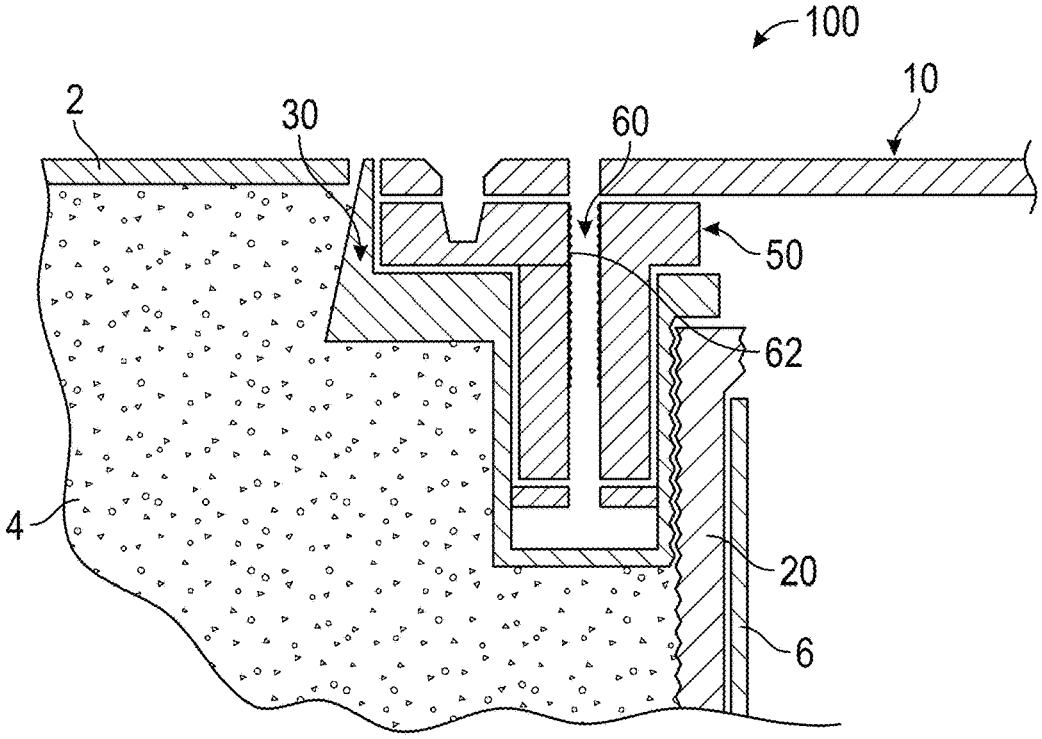
FIG. 2 illustrates one side of a cross section of one embodiment of an adjustable drain apparatus installed in a floor, with a leveling member not shown.

FIG. 2 illustrates a cross-section of FIG. 1A but with the leveling member 70 removed. FIG. 2 illustrates an example of one embodiment in which the threading 62 in the actuation aperture 60 does not extend to a bottom end of the actuation aperture 60. This can assist when assembling the adjustable drain apparatus 100, because it can help allow a leveling member 70 to be inserted into and aligned with the actuation aperture 60 before needing to engage the leveling member 70 with the thread 62. In some embodiments, at least the bottom ⅛ (one eighth) inch of the actuation aperture 60 can be without threads 62. In some embodiments, at least the bottom ¼ (one quarter) inch of the actuation aperture 60 can be without threads 62. In some embodiments, at least the bottom ½ (one half) inch of the actuation aperture 60 can be without threads 62.

Figure 3:
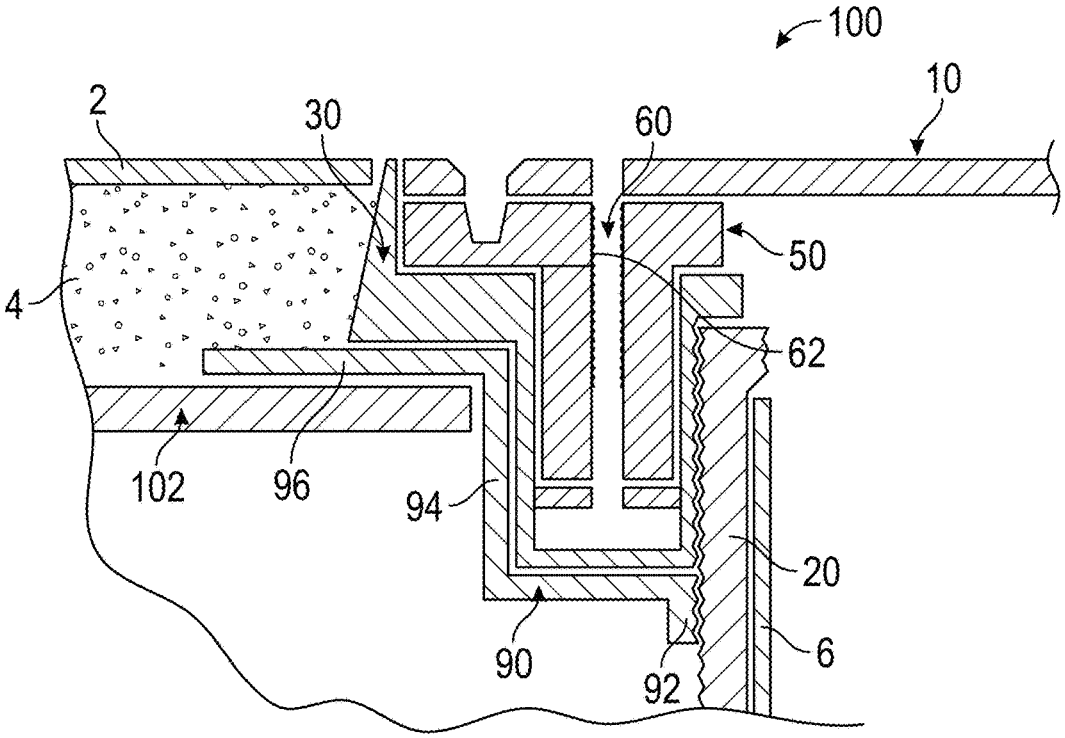
FIG. 3 illustrates one side of a cross section of one embodiment of an adjustable drain apparatus installed in a floor with a base floor.

In some embodiments, where a base floor 102, such as a wood or corrugated floor, is in place, an adjustable drain apparatus 100 can include components that can help set the drain apparatus 100 relative to the base floor 102. For example, with reference to FIG. 3, in some embodiments the adjustable drain apparatus 100 can include an outer collar 90 that can attach to the collar 20. The outer collar 90 can include a threaded attaching portion 92 that can engage exterior threads on the collar 20. In some embodiments, the outer collar 90 can also include a wall 94 and an outer flange 96 that can extend onto the base floor 102. In some embodiments, concrete 4 and/or flooring 2 can then be positioned above the base floor 102, such as described above.

Figure 4A:
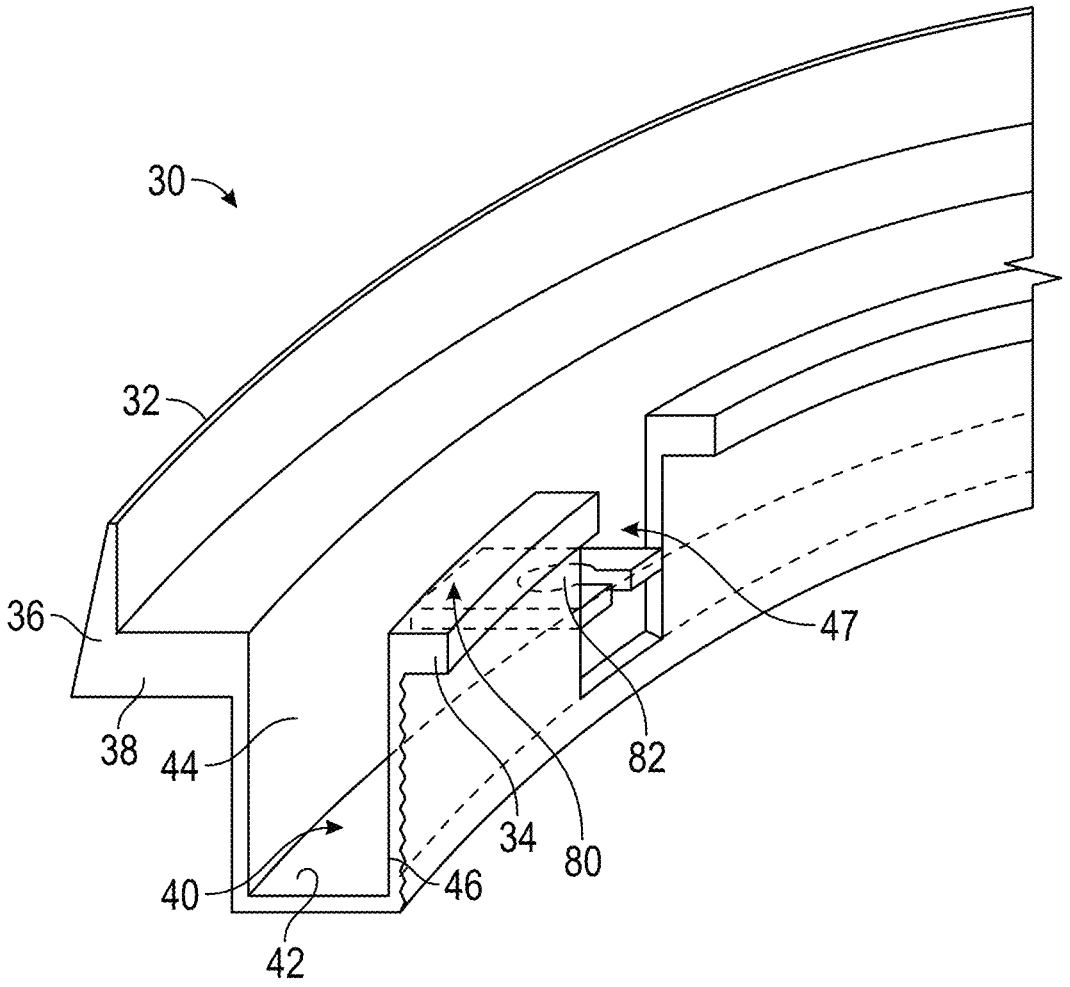
FIG. 4A illustrates a section of a perspective view of one embodiment of a housing.

FIG. 4A illustrates a cutaway perspective view of a portion of a generally cylindrical outer housing 30 that can be used with the drain apparatus 100. As shown for example in FIG. 4A, in some embodiments the housing 30 can include a housing channel 40, an outer wall 44, an inner wall 46, and a base or bottom 42. In some embodiments, the channel 40 can extend around an entire circumference of the housing 30. In some embodiments, the housing 30 can include multiple channels 40, each of which extends around only a portion of a circumference of the housing 30.

FIG. 4A also illustrates one embodiment of a plate 80 that can be used to lock the position of a leveling member 70 relative to the housing 30, for example as described above by using the plate 80 or other blocking structure. The plate 80 is shown in FIG. 4A mostly as dotted lines because in the view shown and as oriented the plate 80 is mostly behind other features of the housing 30. As used herein, references to locking, blocked, fixing, etc. the position of the leveling member 70 relative to the housing 30 refer to translational position. It is understood that in some embodiments the leveling member 70 may rotate relative to the housing 30.

Figure 4B:
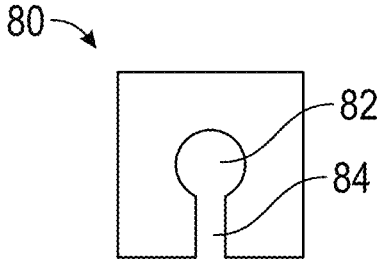
FIG. 4B illustrates a top view of one embodiment of a plate.

FIG. 4B illustrates a top view of one embodiment of a plate 80 that can be used with the drain apparatus 100. The plate can include a hole 82 through which a portion of the leveling member 70, such as the shaft of the leveling member 70, can pass. In some embodiments, the plate 80 can also include a connecting cutout or channel 84 that joins the hole 82 with an exterior surface of the plate 80. The connecting channel 84 can be used to allow the leveling member 70 to be positioned through the hole 82. For example, when installing an adjustable drain apparatus, the leveling member 70 can be inserted through an opening 47 in the inner wall 46 that is preferably aligned with the plate 80. The leveling member 70 can be inserted through the channel 84 until a head, such as the head 72, of the leveling member 70 is below the plate 80 and a shaft, such as the shaft 74, of the leveling member 70 extends through the hole 82. Each leveling member 70 of the adjustable drain apparatus 100 can be positioned accordingly, and the frame 50 can be inserted into position with the leveling members extending into a corresponding actuation aperture 60 of a locking block 52. The leveling members 70 can then be actuated to move the frame 50 and locking blocks 52 into or further into the channel 40.

Figure 4C:
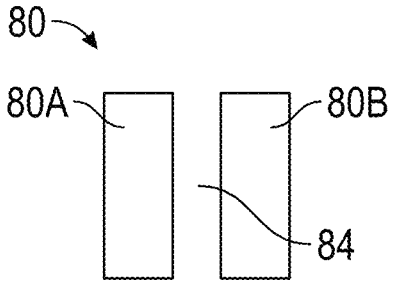
FIG. 4C illustrates a top view of one embodiment of a plate.

Instead of a single structure, in some embodiments two separate blocking structures can be used to block the head 72 of a leveling member 70. For example, FIG. 4C illustrates an embodiment of a locking plate 80 that includes a first member 80A and a second member 80B with a cutout or channel 84 that extends between the entirety of both the first and second members 80A, 80B. The channel 84 is preferably wide enough to allow the shaft 74 of a leveling member 70 to pass, but narrow enough to block the head 72 of the leveling member 70.

The plate 80 is preferably offset from the bottom 42 of the channel 40 to provide room for a head 72 of a leveling member 70. In some embodiments, the plate 80 can be positioned a distance above the bottom 42 that is approximately equal to the thickness of a head 72 of a leveling member 70. In some embodiments, plate 80 can be positioned a distance greater than the thickness of the head 72 above the bottom 42. The plate 80 can be attached to the housing 30, such as at the outer wall 44 and/or at a side wall of the opening 47, through a variety of aspects known in the art, such as through welding, gluing, or other attachment methods. The housing 30, including the plate 80, can be made of a variety of materials. In some embodiments, the plate 80 and/or other parts of the housing 30 can be formed of plastic, polymer, composites, other materials, or combinations thereof. In some embodiments, the plate 80 can be metal. In some embodiments, the entire housing 30 can be metal.

Figure 5:
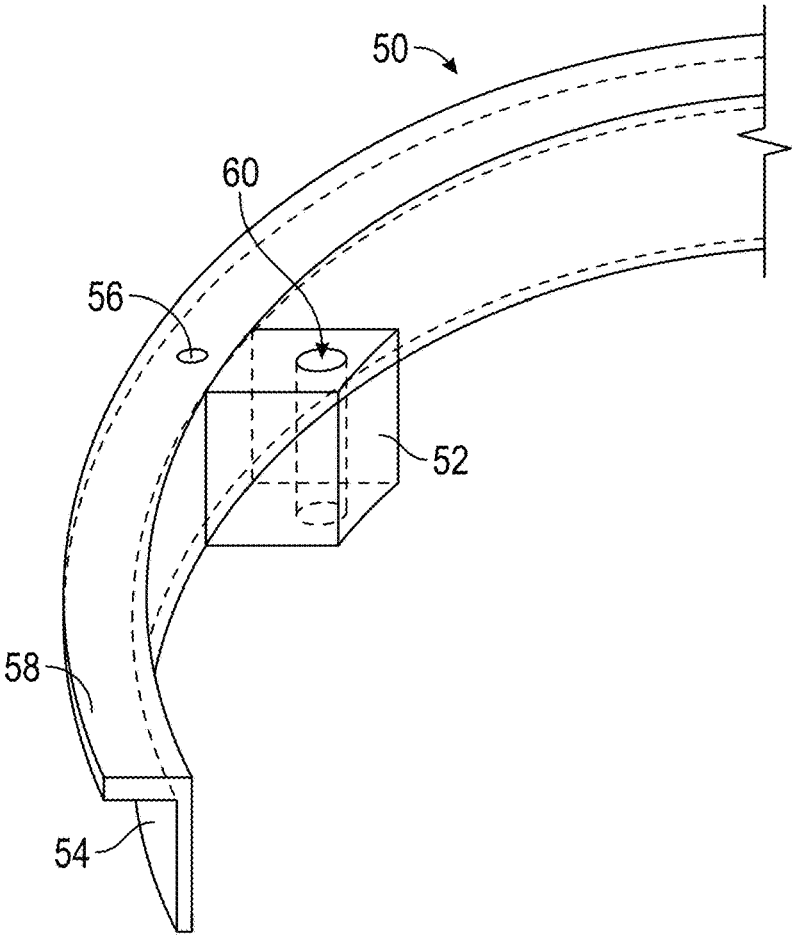
FIG. 5 illustrates a section of a perspective view of one embodiment of a leveling frame.

FIG. 5 illustrates a section of a perspective view of the leveling frame 50. As shown by example in FIG. 5, the leveling frame 50 can include one or more locking blocks 52 that extend inward from a fin 54 of the leveling frame 50. Preferably, the leveling frame 50 forms a complete circle and has three locking blocks 52 spaced equally around its circumference. The locking blocks 52 can include an actuation aperture 60, which can receive a leveling member 70 as discussed above. The leveling frame 50 can include an outer ring or flange 58 with one or more attachment holes 56, which can be used to secure the leveling frame 50 to a grate, such as the grate 10 described herein.

FIG. 5 does not illustrate the flange 59 shown in FIG. 1A, although it is understood that in various embodiments the leveling frame 50 can include an inner flange 59 associated with each locking block 52, or an inner flange 59 that extends circumferentially around the entire leveling frame 50. In some embodiments, the leveling frame 50 may not have any inner flange.

In some embodiments, the fin 54 can extend around an entire circumference of the leveling frame 50. The fin 54 can help prevent any fluid that enters between the housing 30 and the leveling frame 50 (such as concrete, grout, or other fluids or semi-solids) from entering the drain pipe 6. Any such fluid would need to pass all the way below the fin 54 and then rise above the top of the channel 40. In some embodiments, the portions of the fin 54 not aligned with locking plates 80 can extend to the bottom surface 42 of the channel 40.

Figure 6:
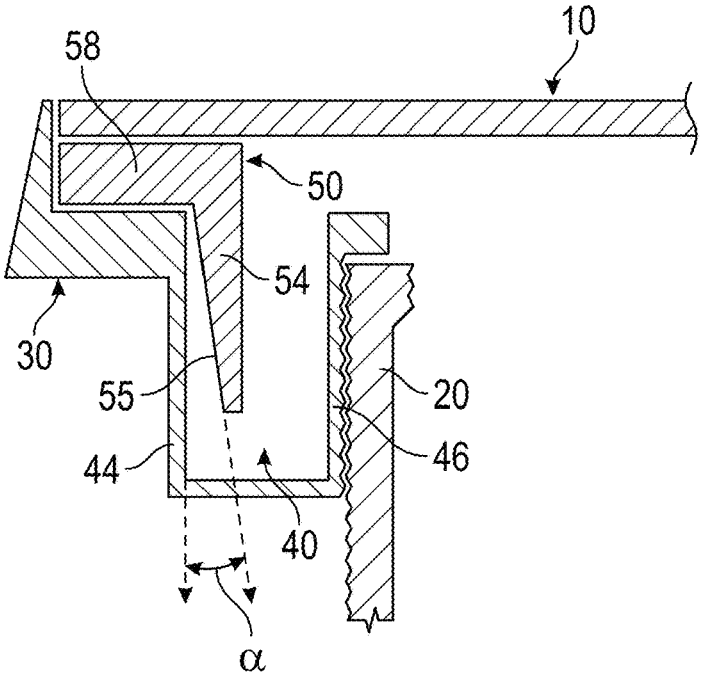
FIG. 6 illustrates a cross section of one embodiment of an adjustable drain apparatus with an angled fin.

In some embodiments, to help allow the leveling frame 50 to angle relative to the housing 30 and prevent it from binding, it can be desirable for the fin 54 of the leveling frame 50 to have an angle. FIG. 6 illustrates an example of one embodiment in which an outer wall 55 of the fin 54 is angled relative to an outer wall 44 of the housing 30. In some embodiments, the resulting angle $\alpha$ can be between 0 degrees and 15 degrees. In some embodiments, the angle $\alpha$ can be between 2 degrees and 12 degrees. In some embodiments, the angle $\alpha$ can be between 3 degrees and 10 degrees. In some embodiments, the angle $\alpha$ can be between 4 degrees and 8 degrees. In some embodiments, the fin 54 can be angled in the opposite direction, such that a bottom end of the fin can be closer to the outer wall 44 than a top end of the fin. In some embodiments, rather than or in addition to angling the fin 54, the channel 40 can be sized such that there is a gap between the outer wall 44 and the fin 54.

Figure 7:
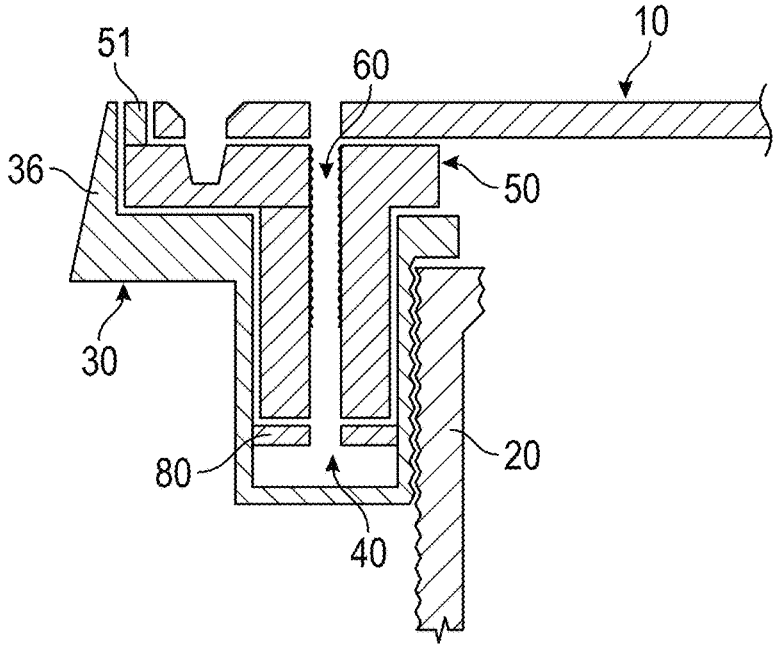
FIG. 7 illustrates a cross section of one embodiment of an adjustable drain apparatus having a leveling frame with an upper ring.

In some embodiments the leveling frame 50 can have a portion that extends past a bottom surface of the grate 10. For example, as illustrated in FIG. 7, in some embodiments the leveling frame 50 can have an upper ring 51 that extends upward between the grate 10 and the outer wall 36 of the housing 30. In some embodiments, the upper ring can be flush with a top surface of the grate 10. In some embodiments, the upper ring 51 can be formed of a material different from the rest of the leveling frame 50. For example, in some embodiments, the upper ring 51 can be metal and the rest of the leveling frame can be plastic. In some embodiments, the upper ring 51 can be provided as a metal ring and the remainder of the leveling frame 50 can be injection molded onto the bottom of the ring 51 in order to form the leveling frame 50. In some embodiments, the upper ring 51 can be integral with another feature or features of the leveling frame 50. The upper ring 51 can help when positioning the grate 10 over the leveling frame 50. The upper ring 51 can also allow materials, for example concrete and/or grout, to be placed tightly against the ring 51 while still allowing the grate 10 to be easily removed.

Figure 8B:
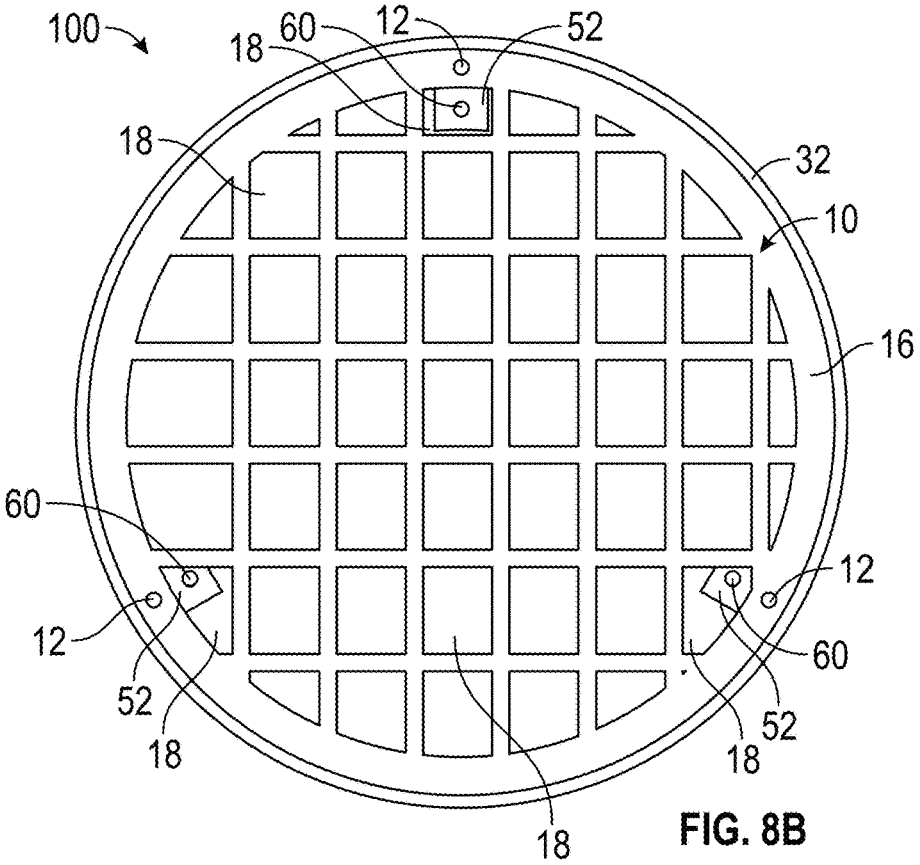
FIG. 8B is a top view of the adjustable drain apparatus of FIG. 8A with a grate shown.

FIG. 8A illustrates a top view of one embodiment on an adjustable drain apparatus 100 without a grate. The apparatus 100 is preferably cylindrical or generally cylindrical, for example as illustrated. The tip 32 of the outer wall of the housing, such as the housing 30 described herein, is drawn with a width, but in some embodiments the tip 32 can be just an edge that surrounds a portion of the leveling frame 50. FIG. 8B illustrates an embodiment of the adjustable drain apparatus 100 with the grate 10 attached. As shown in FIG. 8B, the attachment openings 12 can be used to attach the grate 10 to the frame 50. Preferably, the actuation aperture 60 is accessible through the grate 10. This allows for adjusting the height and/or angle of the leveling frame 50 and grate 10 without having to remove the grate 10. In some embodiments, for example as illustrated, the actuation aperture 60 can be accessed through grate openings 18. In some embodiments, an outer rim 16 of the grate can be thicker and can extend over the actuation aperture 60. In such embodiments, the outer rim 16 can include actuation openings 14 (such as illustrated in FIG. 1A) that can be aligned with actuation apertures 60.

Figure 9:
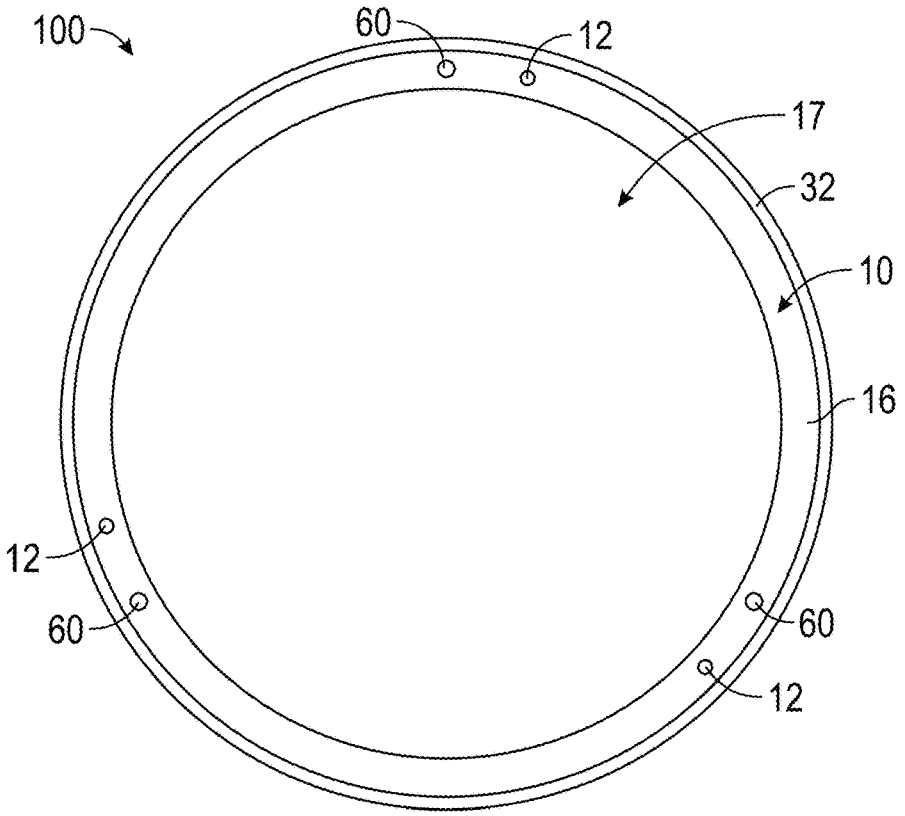
FIG. 9 is a top view of one embodiment of an adjustable drain apparatus.

In some embodiments, for example as shown in FIG. 9, an adjustable drain apparatus 100 can be configured with the actuation apertures 60 and the attachment openings 12 both positioned about the same distance from the center of a grate (e.g., in a shared circumference of the grate). Further examples are illustrated and described in more detail below. Having the actuation apertures 60 and attachment openings 12 a similar distance from the center of the grate can make it possible to include both the apertures 60 and the openings 12 within a narrower outer rim 16, thereby allowing for more space on the grate 10 that can permit fluid to flow through. FIG. 9 does not illustrate grate openings 18, but it is understood that a central portion 17 of the grate 10 can include grate openings of varying designs, including for example the designs shown in FIG. 8B. Further, any of the embodiments of the drain apparatus 100 and/or grate 10 as shown in FIGS. 8A-9 may be included in or with the other embodiments of the drain assembly disclosed herein, for example with the grate 10 and/or the leveling frame 50 depicted and described with respect to FIG. 3.

Figure 10:
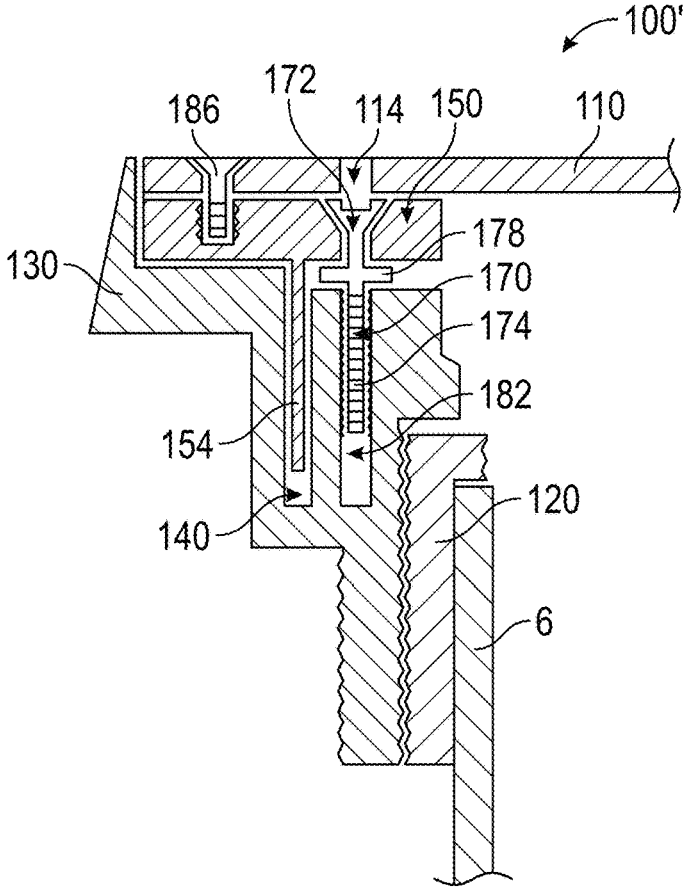
FIG. 10 illustrates a cross section of an alternate embodiment of an adjustable drain apparatus.
Figure 11:
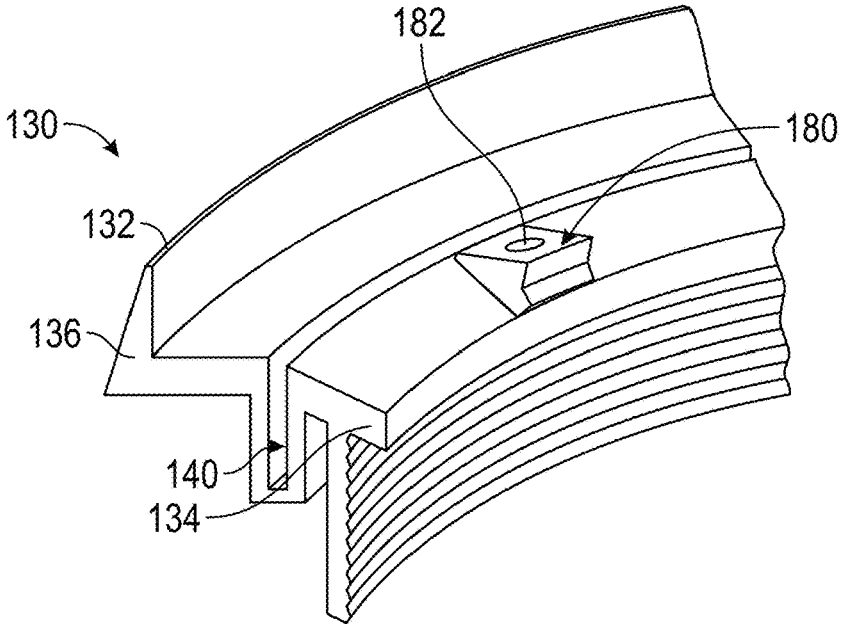
FIG. 11 illustrates a section of a perspective view of one embodiment of a housing.
Figure 12:
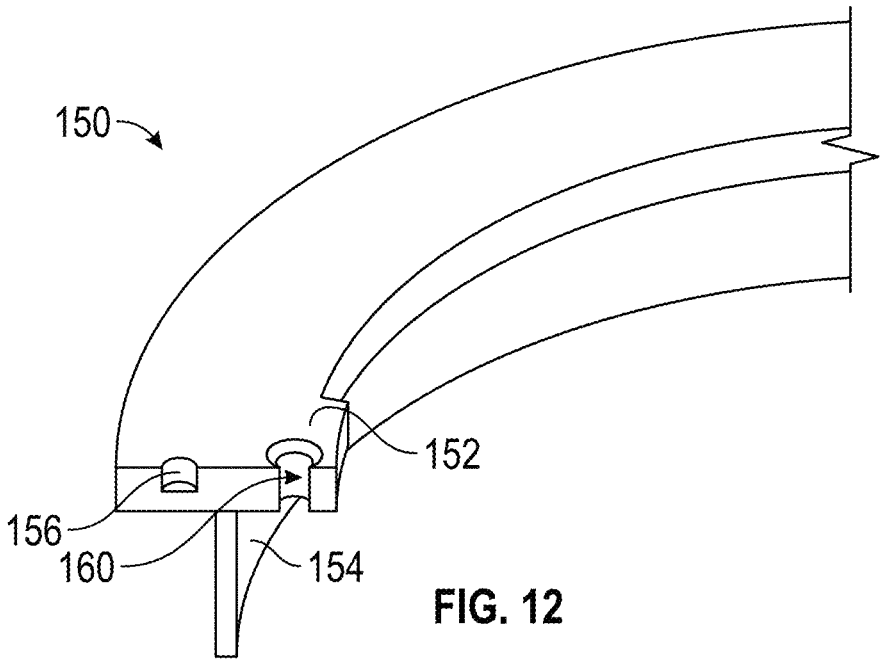
FIG. 12 illustrates a section of a perspective view of one embodiment of a leveling frame.

FIGS. 10-12 illustrate an alternate embodiment of an adjustable drain apparatus 100' that can be used to adjust the height and/or angle of a grate 110. In some embodiments, the adjustable drain apparatus 100' can be adjusted without needing to remove the grate 110 from a leveling frame 150. FIG. 10 illustrates a cross-section of a portion of the adjustable drain apparatus 100'. The apparatus 100' can be positioned relative to a drain pipe 6 and floor as described above. Further, it is understood that elements labeled with numbers similar to those from previous embodiments may operate in a manner similar to that described above unless otherwise mentioned. Thus, for example, the adjustable apparatus 100' can include a housing 130 with a channel 140 that can receive a fin 154 of a leveling frame 150.

In contrast to prior embodiments, however, when adjusting the leveling frame 150, the leveling member 170 can move relative to the housing 130. The leveling member 170 can include a threaded shaft 174 that can be inserted into and engage threading within a locking hole 182 of the housing. The leveling member can include a flange 178 between the housing 130 and the leveling frame 150 that can be used to engage and move the leveling frame 150 when the leveling member 170 is screwed in a direction that raises the leveling member 170 relative to the housing 130.

The leveling member 170 can also include a head 172 that can be wider than a shaft 174 of the leveling member 170. The head 172 can interact with the leveling frame 150 to help lock the leveling frame 150 relative to the housing 130. Thus, the leveling member 170 can serve to both adjust the height and/or angle of the leveling frame 150 and secure the leveling frame 150 to the housing 130. FIG. 10 also illustrates a locking screw 186 that can be used to lock the grate 110 to the leveling frame 150. Similar locking screws can be used in other embodiments described herein to lock grates to leveling frames.

FIG. 11 illustrates a section of a perspective view of a housing 130 that can be used with the drain apparatus 100'. The housing can include a locking structure 180 that can include a locking hole 182 to receive a leveling member 170. The housing 130 can have a plurality of locking structures 180 positioned about the circumference of the housing. In some embodiments, such as described above with respect to the housing 30, the housing 130 can include three locking structures positioned generally equidistant around the circumference, or more or fewer locking structures in other positions.

FIG. 12 illustrates a section of a perspective view of a leveling frame 150 that can be used with the drain apparatus 100'. In some embodiments, for example as illustrated, the leveling frame 150 can include an attachment screw hole 156 and an actuation aperture 160 that can receive a portion of a leveling member 170. In some embodiments, the leveling frame 150 can have a flanged section or flange 152 through which the actuation aperture 160 extends. In some embodiments, the leveling frame 150 can have a flanged section 152 and actuation aperture 160 that correspond to each locking structure 180 of the housing 130.

In some embodiments, the actuation aperture 160 can extend laterally to form an opening in a wall (e.g., an inner wall) of the flange 152. This can allow a leveling member 170 to slide horizontally or otherwise sideways into position within the aperture 160, similar to how a leveling member 70 can be positioned within the hole 82 of the plate 80 of FIG. 4A. When assembling an adjustable drain apparatus 100', the leveling member 170 can be positioned within the actuation aperture 160 and then the leveling frame 150 with leveling member 170 can be positioned on the housing 130. The leveling member 170 can then be actuated to move it into the locking hole 182, such as by screwing the leveling member 170 into the locking hole 182.

Figure 13:
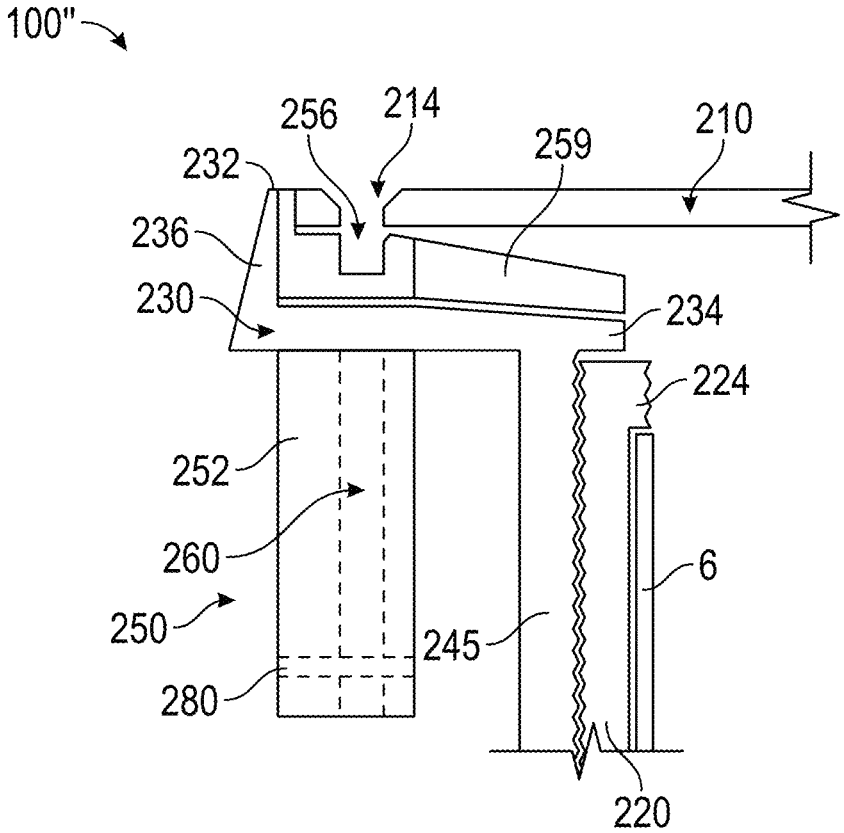
FIG. 13 illustrates a cross section of an alternate embodiment of an adjustable drain apparatus.
Figure 14:
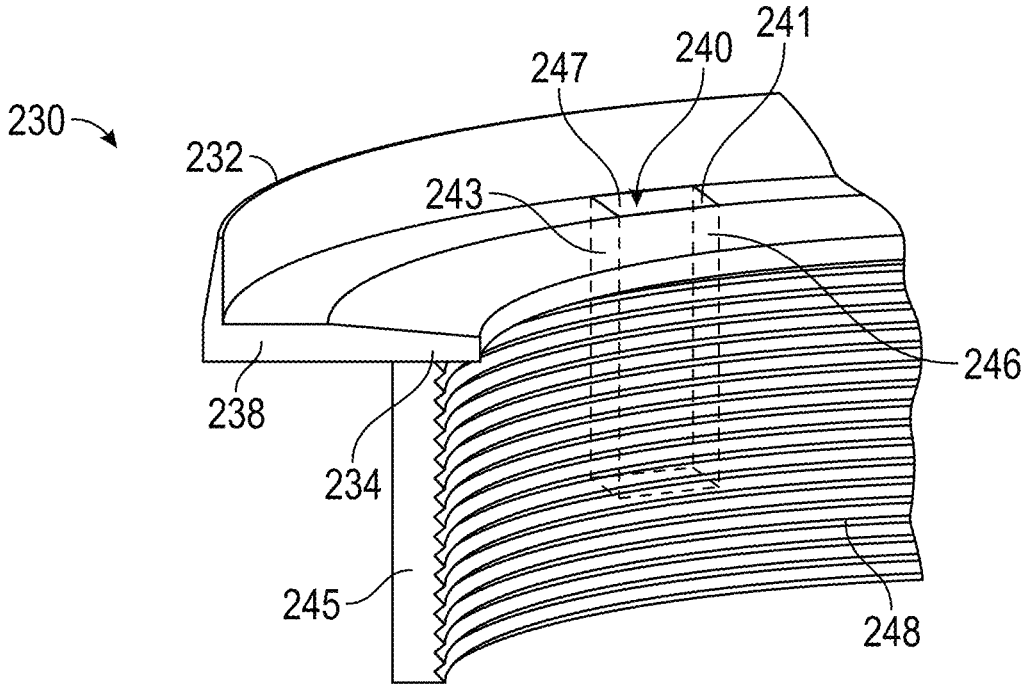
FIG. 14 illustrates a section of a perspective view of one embodiment of a housing.
Figure 15:
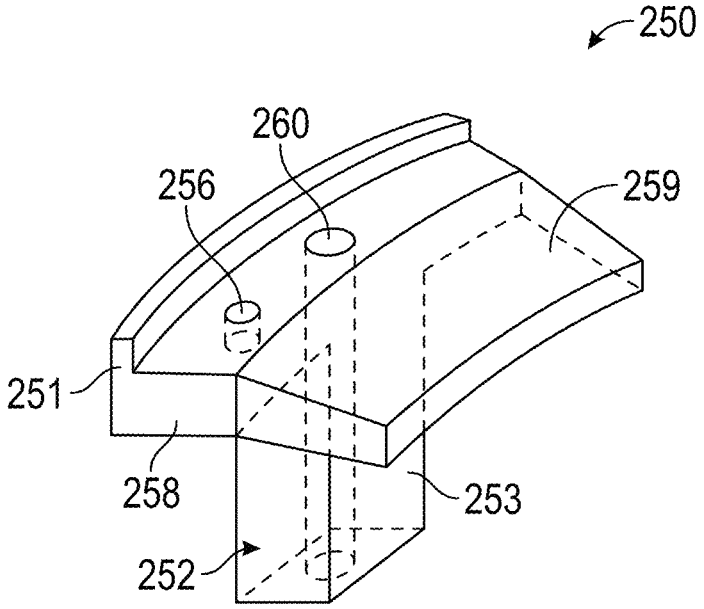
FIG. 15 illustrates a section of a perspective view of one embodiment of a leveling frame.

FIGS. 13-15 illustrate an alternate embodiment of an adjustable drain apparatus 100" that can be used to adjust the height and/or angle of a grate 210. In some embodiments, the drain apparatus 100" can be adjusted without needing to remove the grate 210 from a leveling frame 250. FIG. 13 illustrates a cross-section of a portion of the adjustable drain apparatus 100". The apparatus 100" can be positioned relative to a drain pipe 6 and floor as described above. Further, it is understood that elements labeled with numbers similar to those from previous embodiments may operate in a manner similar to that described above unless otherwise mentioned. Thus, for example, the adjustable apparatus 100" can include a housing 230, a collar 220, and a leveling frame 250. Similarly, the leveling frame can include a locking block 252 with an actuation aperture 260 that can receive a leveling member. Also as above, a plate 280 can interfere with a head of the leveling member to retain the leveling member in position relative to the housing 230. In various embodiments the plate 280 can have a variety of configurations, including those described herein, such as the plates 280 illustrated in FIGS. 4B and 4C.

FIG. 14 illustrates a portion of a perspective view of the housing 230 that can be used with the apparatus 100". In some embodiments, for example as illustrated, rather than having a single circumferential channel, the housing 230 can include one or more channels or shafts 240 that can be configured to receive locking blocks 252 of the locking frame 250. This can help limit required materials for fabricating the device. In some embodiments, the housing 230 can have a plurality of shafts 240 with each shaft 240 corresponding to a respective one of a plurality of locking blocks. In some embodiments, the housing 230 can have three shafts 240 positioned equidistant about the circumference of the housing. In some embodiments, the housing can have more than three shafts and/or at various locations relative to each other.

In some embodiments, the shaft 240 can be defined by a first side wall 243, a second side wall 241, and an inner side wall 246. In some embodiments, the shaft can have an opening 247 on its outer side (e.g., have an opening in an outer wall or have no outer wall) that can allow a leveling member to be positioned within the shaft 240 with a head of the leveling member below a plate and a shaft of the leveling member extending above the plate (for clarity, the plate is not illustrated in FIG. 14 but it can be seen in FIG. 13). Once a leveling member has been positioned in each shaft 240, the leveling frame 250 can be positioned on the housing 230.

In some embodiments, the housing 230 can include a housing collar 245 that engages the collar 220 (shown in FIG. 13). In some embodiments, this engagement can be with interior threading 248 of the housing collar 245. In some embodiments, the housing collar 245 can be separated by a gap from an inner wall 246 of the shaft 240 (the gap is most easily visible in FIG. 13). In some embodiments, struts, braces, or other structures can be used to connect the shaft 240 and the housing collar 245 to help support the shaft 240.

FIG. 15 illustrates a section of a perspective view of the leveling frame 250 that can be used with the apparatus 100". The leveling frame 250 can include an actuation aperture 260 and an attachment screw hole 256 that can be used to attach the leveling frame 250 to a grate. In some embodiments, rather than having the actuation aperture 260 and screw hole 256 aligned radially, they can be aligned circumferentially, for example as illustrated. The frame 250 can thus be used with a grate 10 such as that described with respect to FIG. 9, which can provide a greater area through which fluid can flow.

In some embodiments, the leveling frame 250 can include an inner flange 259. The inner flange can be configured to align with the housing, for example as shown in FIG. 13. This can help prevent water that flows through the grate 210 from flowing into the shaft 240 of the housing 230. In some embodiments, the flange 259 can extend around an entire circumference of the leveling frame 250. In some embodiments, the leveling frame 250 can include a flange 259 associated with each locking block 252. In some such embodiments, each flange 259 can have the same circumferential width as its corresponding locking block 252. In some embodiments, each flange 259 can be wider than its corresponding locking block 252, for example as illustrated.

In some embodiments, each locking block 252 can be sized such that it maintains a relatively flush fit within a corresponding shaft 240. In some embodiments, the shafts 240 can be larger than the locking blocks 252. This can allow some play, for example angling and/or other movements, of the locking blocks 252 within the shafts, which can prevent binding when leveling members are actuated in such a way as to angle the leveling frame 250.

Figure 16A:
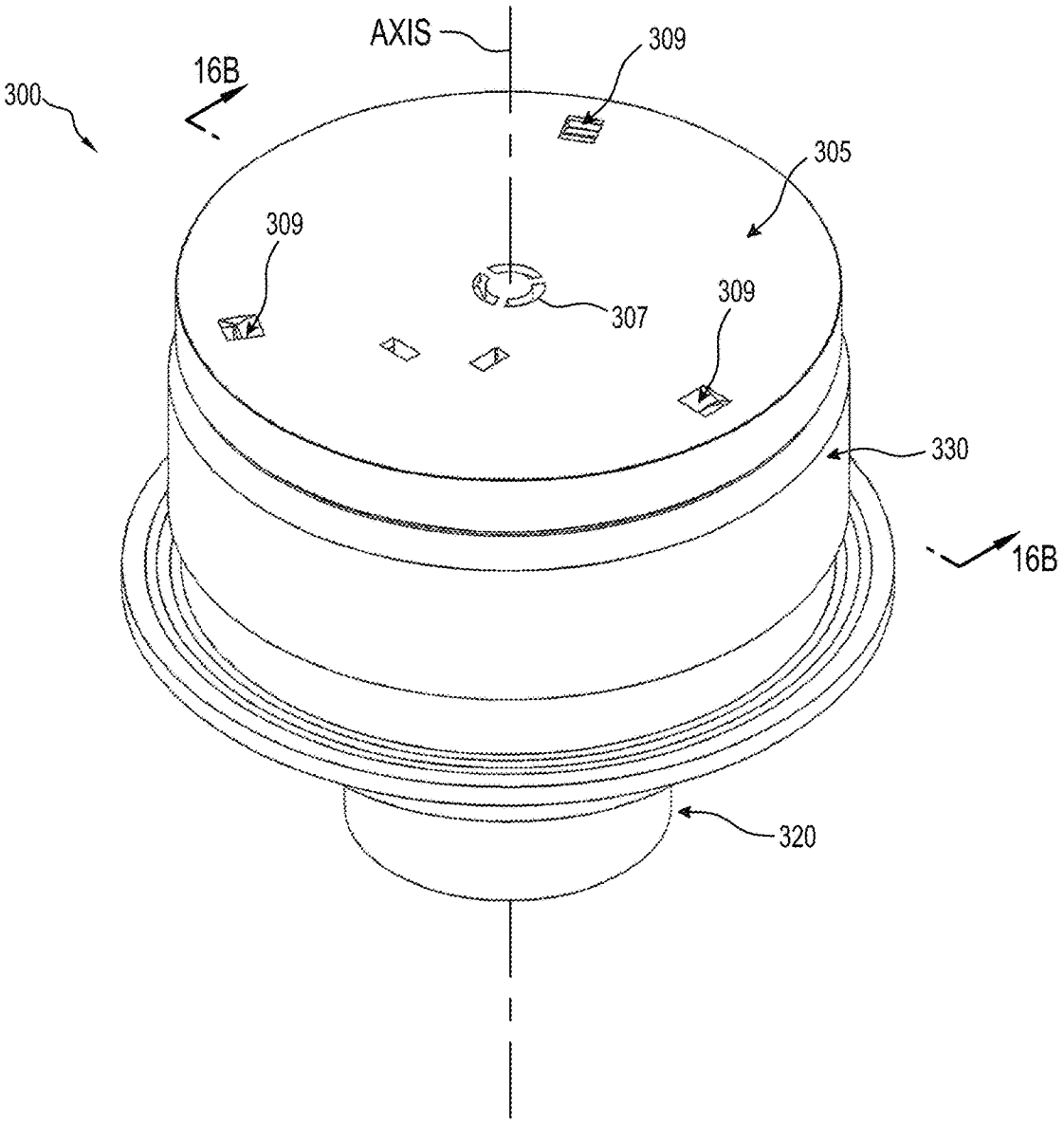
FIGS. 16A-16C are various views of another embodiment of an adjustable drain apparatus.
Figure 16B:
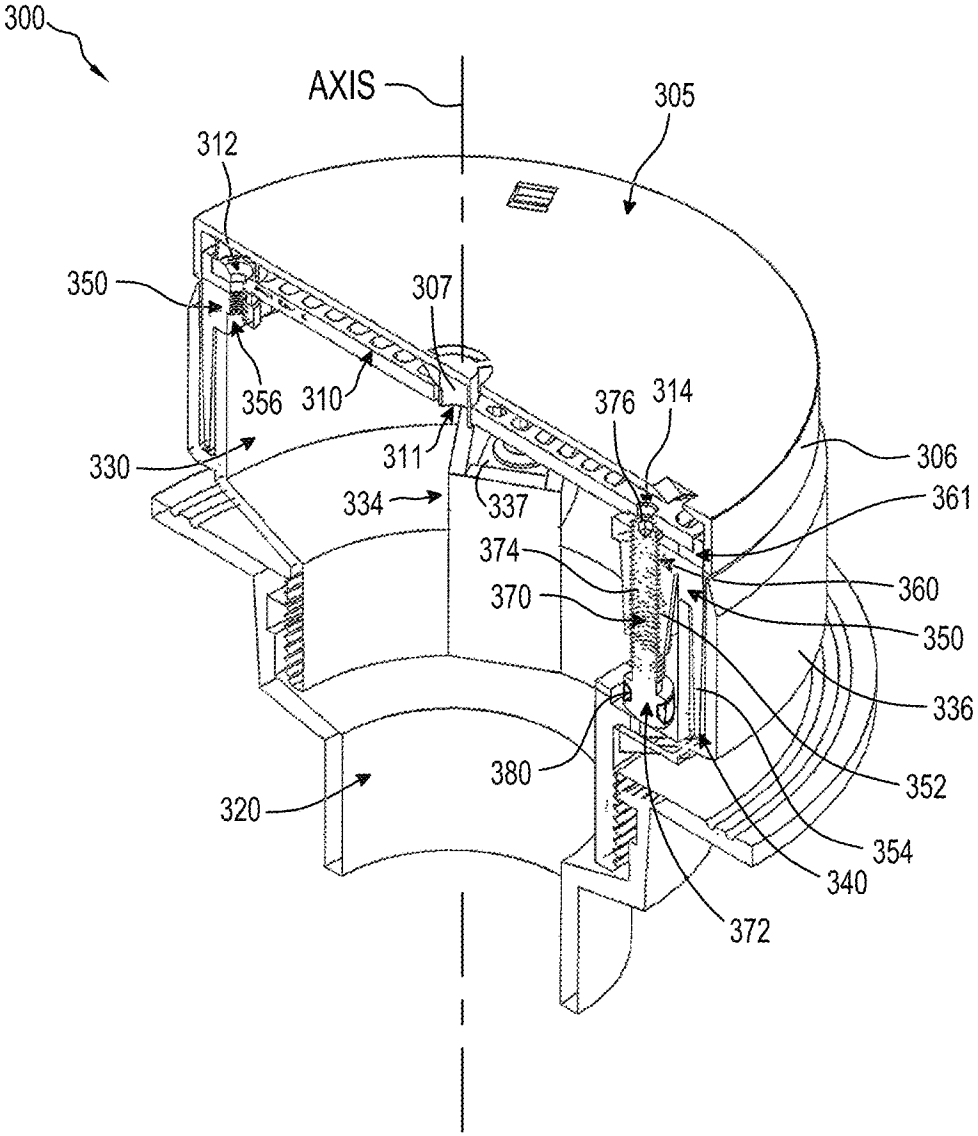
Figure 16C:
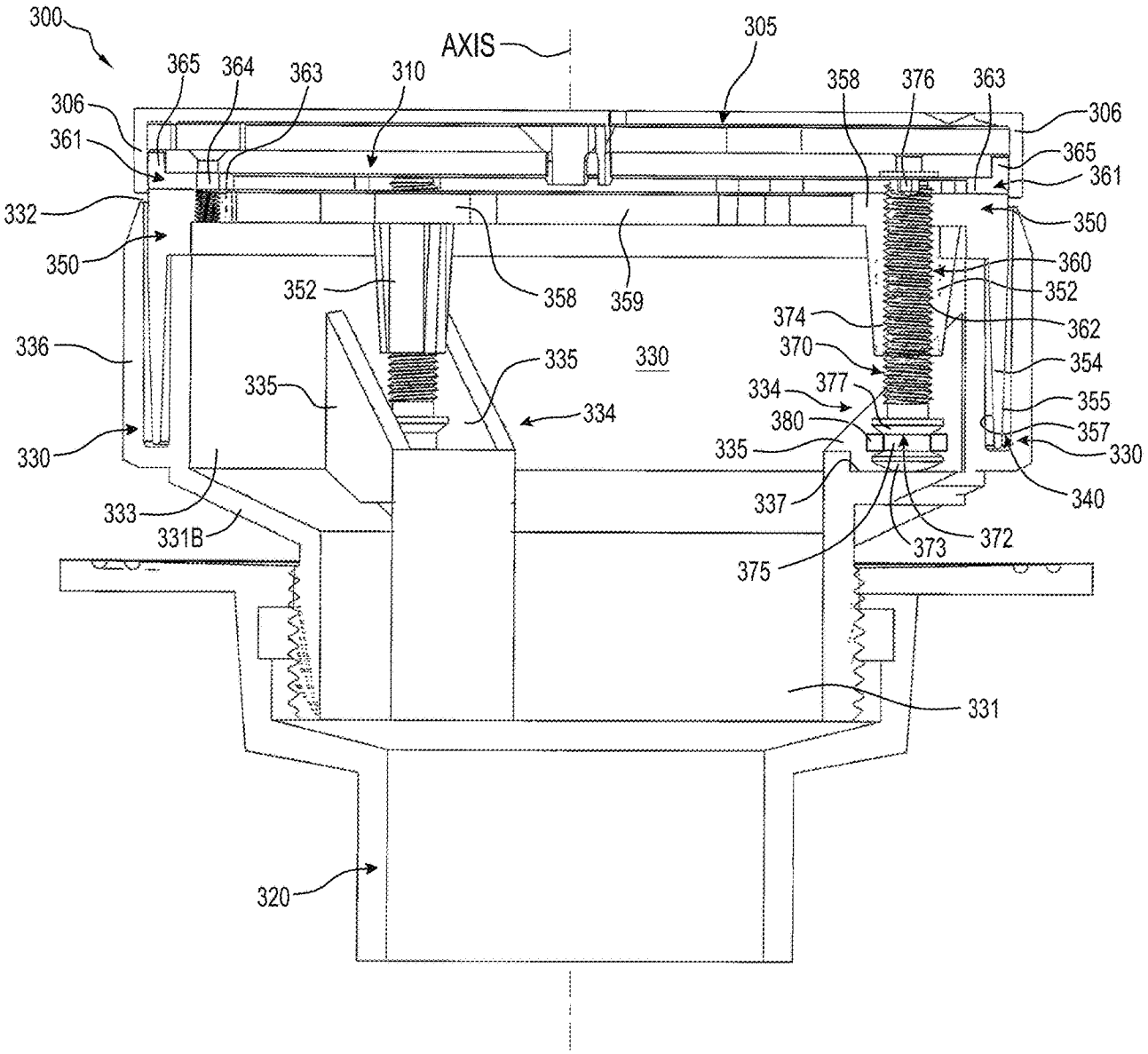

FIGS. 16A-16C are various views of another embodiment of an adjustable drain apparatus 300. FIG. 16A is a perspective view of the apparatus 300 and FIGS. 16B and 16C are cross-section views of the apparatus 300 as taken along the line 16B-16B indicated in FIG. 16A. In addition or alternatively to the description below, the apparatus 300 may be analogous to other drain apparatuses described herein, such as the apparatuses 100, 100' and/or 100". By "analogous" it is meant that the drain apparatuses may have the same or similar features and/or functionalities as each other, even if those features or functionalities are only described with respect to one or the other drain apparatuses. A central, longitudinal axis is indicated in FIGS. 16A-16C for geometrical reference only and for the sake of description of some embodiments of the apparatus 300.

Referring to FIG. 16A, the apparatus 300 may include a cover 305, a collar 320, and/or a raising core or housing 330. The collar 320 and housing 330 may be analogous to other covers, collars and housing described herein, such as the collar 20 and housing 30, respectively.

The cover 305 may be a generally rounded and flat structure. The cover 305 may have a lip 306 along an outer edge thereof. The lip 306 may extend axially downward from or near the edge of the cover 305. The cover 305 may attach to various features of the apparatus 300, as described herein, to act as a lid and cover the drain apparatus 300. The cover 305 may include an attachment 307 for connection to the apparatus 300. The attachment 307 may protrude downward from the cover 305, for example at or near the center of the cover 305. The attachment 307 may include one or more flexible protrusions, such as tabs, that can extend into one or more openings of the apparatus 300 to keep the cover 305 attached to the apparatus, for example during construction and before use of the drain thereunder. The attachment 307 may connect to a grate 310, as further described. The cover 305 may include one or more openings 309. As shown, there may be three openings 309. The openings may extend through the cover 305 to provide access for a tool, such as a screw driver tip, to facilitate removal of the cover 305 from the drain apparatus 300 after concrete or other filler has been poured around the apparatus 300. In some embodiments, the concrete or other filler may be poured up to the top surface of the cover 305. The cover 305 may then be removed prior to hardening of the concrete.

Referring to FIGS. 16B and 16C, the apparatus 300 may include a strainer or grate 310. The grate 310 may be analogous to other grates described herein, such as the grate 10. The grate 310 may be formed of metal, alloy, plastic, polymer, composites, other suitable materials, or combinations thereof. The grate 310 may be a generally flat, rigid structure having openings therein to allow fluid to flow through the grate 310 and into the apparatus 300. The grate 310 may include an opening 311 into which the attachment 307 of the cover 310 is received. The grate 310 may include attachment openings 312 and 314, which may be analogous to attachment openings 12 and 14. The attachment opening 312 may receive a fastener therethrough to allow for attachment of the grate 310 to a leveling frame 350, as further described herein. The attachment opening 314 may allow for access to a leveling member 370 for adjusting the frame 350, as further described herein. As further described, the apparatus 300 may include the grate 310 securable to the leveling frame 350, the grate 310 comprising a plurality of openings 312, each of the plurality of openings 312 configured to be aligned with a threaded bore (e.g. within an actuation aperture 360) of a respective one of a plurality of locking blocks 352 of the frame 350.

The apparatus 300 may include the collar 320. The collar 320 may extend circumferentially about a central longitudinal axis of the apparatus 300. "Circumferentially," and the like, as used herein includes but is not limited to cylindrical, rounded, arcuate, etc. it may or may not include the longitudinal axis as a center of rotation. The collar 320 may extend circumferentially about the axis and be configured to couple with a drain pipe. The collar 320 may provide a connection between a drain pipe and the apparatus 300. The collar 320 may extend around or within a drain pipe (not shown). The collar 320 may extend upward from the drain pipe to an enlarge diameter upper section having threads to engage the apparatus 300, as further described. The collar 320 may be formed of metal, alloy, plastic, polymer, composites, other suitable materials, or combinations thereof.

The apparatus 300 may include the housing 330. The housing 330 may be formed of metal, alloy, plastic, polymer, composites, other suitable materials, or combinations thereof. The housing 330 may extend circumferentially about the axis and be configured to couple with the collar 320. The housing 330 may comprise therein a plurality of receiving areas 334, each receiving area having a bottom 337, as further described. The housing 330 may include a lower wall 331 and an inner upper wall 333. The walls 331, 333 may extend circumferentially about the axis of the apparatus 300. The lower wall 331 may couple with, for example attach directly to, the collar 320. As shown, the lower wall 331 may include outer threads that engage inner threads of an upper portion of the collar 320. The lower and upper walls 331, 333 may be connected by an angled segment or portion 331B that extends radially outward and upward from the lower wall 331. The housing 330 may comprise the upper wall 333 having a first diameter, the lower wall 331 having a second diameter smaller than the first diameter, and the angled portion 331B extending upward and outward from the lower wall 331 to the upper wall 333, wherein the lower wall 331 is configured to couple with the collar 320. When installed, for example with a drain pipe, the apparatus 300 may be surrounded by concrete or other filler underneath and around the angled portion 331B and above the collar 320, for example to facilitate with structural support of the housing 330 and/or other features of the apparatus 300. The upper wall 333 may be an inner wall located radially inward of the outer wall 336.

The housing 330 may include an upper tip or edge 332. The edge 332 may be at the end of an outer wall 336 of the housing 330. The outer wall 336 may extend circumferentially about the axis along an outer side of the upper wall 330. The edge 332 may be located at the end of the upward extending outer wall 336 and therefore the edge 332 may also extend circumferentially about the axis. When installed, the concrete or other filler may be poured surrounding the housing 330 and near, up to, or above the edge 332.

The housing 330 may include one or more receiving areas or receiving shafts 334. As used herein, the terms "receiving area" and "receiving shaft" are used interchangeably, unless otherwise noted, or otherwise indicated by context. As shown, there may be three receiving shafts 334 spaced angularly equally apart about the axis. In some embodiments, there may be fewer or more than three receiving shafts 334, and/or spaced in a variety of configurations, whether angularly equally or unequally, spaced farther radially inward or outward, etc. The receiving shafts 334 may each include features for receiving, retaining, etc. a corresponding leveling member 370. The receiving shafts 334 may have an open side, such as the radially inward open side as shown, or the sides may be mostly or entirely closed off, as with receiving shaft 334 described herein.

The receiving shafts 334 may each include one or more generally planar ribs 335 and a generally planar bottom 337. In some embodiments, the ribs 335 and bottom 337 may have other shapes, contours, etc. As shown, the ribs 335 may be internal to the housing 330. There may be six ribs 335, or fewer or more ribs 335. There may be pairs of ribs 335 that define spaces in which a leveling member 370 is received, as further described. The ribs 335 may extend from the upper wall 333 to the corresponding bottom 337. The bottom 337 may be analogous to other bottoms described herein, such as the bottom 42. The bottom 337 may provide a structural stop or floor that prevents movement axially downward of the leveling member 370. A pair of the ribs 335 may surround each bottom 337. The ribs 335 may extend beyond the bottom 337. The ribs 335 may be underneath the bottom 337, either in addition to or alternatively to extending above the bottom 337. The bottom 337 may be supported by the angled portion 331B of the housing 330. In some embodiments, the angled portion 331B may form all or part of the bottom 337. Thus, the angled portion 331B and the bottom 337 may be portions of the same continuous, monolithic structure. In some embodiments, the receiving shafts 334 may only include the bottom 337, or the bottom 337 and one rib 335, or the bottom 337 and two ribs, or the bottom 337 and more than two ribs 337. In some embodiments, the receiving shafts 334 may be analogous to other receiving shafts described herein.

The housing 330 may include a channel 340. The channel 340 may be located in between the upper wall 331 and the outer wall 336. The channel 340 may be an opening extending circumferentially about the axis in between the upper and outer walls 331, 336 of the housing 330. The channel 340 may extend in the axial direction, for example down to or near the angled portion 331B of the housing 330. The channel 340 may be open at a top end thereof. The channel 340 may therefore receive features of the apparatus 300, such as features of a leveling frame 350, as further described. In some embodiments, the channel 340 may be analogous to the channel 40.

The apparatus 300 may include a leveling frame 350. The frame 350 may be analogous to other leveling frames described herein, such as the frames 50, 150 and/or 250. The frame 350 may extend circumferentially about the axis. The frame 350 may be formed of metal, alloy, plastic, polymer, composites, other suitable materials, or combinations thereof.

The frame 350 may include a shield or fin 354. The fin 354 may be analogous to other fins described herein, such as the fin 54. The fin 354 may extend circumferentially about the axis and axially down into the channel 340 of the housing 330. The housing channel 340 may be wider than all or portions of the fin 354 such that the fin 354 can be angled within the channel 340, for example as the frame 350 is adjusted and/or after the frame 350 is adjusted. The fin 354 may include an outer surface 355 along an outward side thereof. The outer surface 355 may taper inward as show. In some embodiments, the outer surface 355 may taper outward or may not taper at all, for example extend axially. In some embodiments, the outer surface 355 may include one or more of tapered inward, tapered outward, and/or axial. The fin 354 may include an inner surface 357 along an inward side thereof. The inner surface 357 may be located opposite the outer surface 355. The inner surface 357 may taper outward as show. In some embodiments, the inner surface 357 may taper inward or may not taper at all, for example extend axially. In some embodiments, the inner surface 357 may include one or more of tapered outward, tapered inward, and/or axial. The inner and outer surfaces 355, 357 may be symmetric or mirror images, as shown. In some embodiments, the inner and outer surfaces 355, 357 may not be mirror images and may have a variety of different shapes, contours, protrusions, etc.

The fin 354 may mitigate or prevent debris from entering the drain apparatus 300 when the leveling frame 350 is adjusted upward. For example, one side of the leveling frame 350 may be adjusted upward while the opposite side is stationary or adjusted downward. The portion of the fin 354 that is located underneath the portion of the leveling frame 350 that is adjusted upward will thus cover the area underneath that portion of the frame 350 to block debris from entering. Further, for example, after adjustment as described one side of the fin 354 may be angled outward within the channel 340 and the opposite side of the fin 354 may be angled inward within the channel 340.

The frame 350 may include one or more locking blocks 352. The locking blocks 352 may be analogous to other locking blocks described herein, such as the locking blocks 52 and/or 152. There may be three locking blocks 352 spaced angularly equally apart. The locking blocks 352 may be located on a radially inward side of the fin 354 and extend axially downward. There may be a space in between the locking blocks 352 and the surrounding fins 354. The locking blocks 352 may have various lengths in the axial direction, for example the blocks 352 may be shorter than, longer than, or the same length as the lower edge of the upper wall 333. The locking blocks 352 may have various shapes, for example they may taper in the downward direction as shown, or be straight, taper in the opposite direction, have other shapes, or combinations thereof.

The frame 350 may include an inner ring 359. The inner ring 359 may extend circumferentially about the axis. The locking blocks 352 may extend downward (as oriented) from the inner ring 359. The inner ring 359 may include one or more internal flanges 358. The locking blocks 352 may extend from corresponding flanges 358. There may be three flanges 358. The flanges 358 may extend radially inward from the fin 354. The frame 350 may include the circumferential inner ring 359 with radially-shorter segments located in between the radially—longer flanges 359. The ring 359 may extend radially inward from the fin 354. The ring 359 may be radially shorter than the flanges 358. The ring 359 may provide stiffness to the frame 350. The ring 359 may include openings 356 for attachment of the frame 350 with the grate 310. There may be three openings 356 that align with the attachment openings 312 of the grate 310. The openings 356 may be threaded holes, such that a fastener, such as a screw, may be used to secure the grate 310 to the frame 350, for example by inserting the fastener through the attachment opening 312 and engaging the fastener with the aligned threaded opening 356. Thus, adjustment of the frame 350, as further described, will result in similar adjustment of the grate 310.

The frame 350 may include one or more actuation apertures 360. The actuation apertures 360 may be analogous to other actuations apertures described herein, such as the actuation aperture 60, 160, and/or 260. The locking block 352 may include the apertures 360. There may be one aperture 360 for each locking block 352. In some embodiments, there may be three apertures 360, or fewer or more than three apertures 360. The apertures 360 may be openings or bores extending through corresponding locking blocks 352. The apertures 360 may extend axially or generally axially through the locking blocks 352. The apertures 360 may be internally threaded, either partially or entirely, with threads 362. Thus the apertures 360 may be vertical threaded bores. The threads 362 may extend from the top end, bottom end and/or anywhere in between the top and bottom ends of the apertures 360. The apertures 360 may receive a leveling member 370, as further described, which may engage with the threads 362. In some embodiments, the apertures 360 may include inserts or other features, for example that provide the threads or other engagement features for the leveling members 370. The leveling frame 350 may therefore comprise a ring 359 extending circumferentially about the axis and a plurality of the locking blocks 352 extending downward from the ring 359, each of the plurality of locking blocks 352 comprising a vertical bore (e.g. within the actuation aperture 360) configured to align with a corresponding bottom 337 of the housing 330, the vertical bore at least partially threaded.

The apparatus 300 may include a strain holder 361. The holder 361 may provide a structural support and positioning for the grate 310. The holder 361 may be formed from brass or other metals, alloys, plastics, composites, polymers, other suitable materials or combinations thereof. The holder 361 may be a circumferential ring having a radially inward flange 363 and a lip 365 extending upward, for example axially, therefrom. The holder 361 may include openings 364 in the inward flange 363 through which fasteners may be received. The grate 310 may sit on the flange 363 and within the lip 365 of the holder 361, and thus the holder 361 may be located in between the grate 310 and the frame 350. The openings 364 in the inward flange 363 of the holder 361 may receive the fastener that extends through the grate 310 and into the frame 350, for example in the attachment opening 312 of the grate 310, through the opening 364 in the flange 363, and into the opening 356 of the frame 350. Thus, the holder 361 may be sandwiched in between the grate 310 and the frame 350. The opening 364 may be a threaded hole or a thru-hole. In some embodiments, the holder 361 may be integral with the frame 350. In some embodiments, the holder 361 may be analogous to the inner flange 259 described with respect to the frame 250 above.

The apparatus 300 may include one or more leveling members 370. The leveling member 370 may be analogous to the leveling members 70 and/or 170. The leveling member 370 may include a head 372 on one end of an axial, elongated shaft 374 and a tool receiving portion 376 on an opposite end thereof. The head 372 and shaft 374 may be analogous to the other heads and shafts of leveling members described herein, for example the heads 72, 172 and shafts 74, 174, respectively.

The head 372 of the leveling member 370 may include an end portion 373, a middle portion 375 and a bottom portion 377. The end portion 373 may be located at the end of the leveling member 370, such as at the bottom as oriented in the figures. The end portion 373 may have a width, for example a diameter, that is larger than a width of a corresponding channel in the corresponding plate 380 used to axially secure the leveling member 370, as further described. The middle portion 375 may be adjacent the end portion 373. The bottom portion 377 may be adjacent the middle portion 375. The bottom portion 377 may be adjacent to the shaft 374. The end and bottom portions 373, 377 may have radially enlarge sections relative to the middle portion 375. Thus, the diameters of the end and bottom portions 373, 377 may be larger than the diameter of the middle portion 375. The end and bottom portions 373, 377 may be tapered or otherwise have non-constant diameters, and thus have variable diameter sizes along an axial length of these portions. Thus, the largest diameters of the end and bottom portions 373, 377 may be larger than the diameter of the middle portion 375. The middle portion 375 may have a constant diameter along its length axially. In some embodiments, the middle portion 375 may have a non-constant diameter, and thus the largest diameters of the end and bottom portions 373, 377 may be larger than the largest diameter of the middle portion 375. The space created by the differences in relative diameters of the end, middle and bottom portions 373, 375, 377 may receive a plate 380 therein, as further described, for preventing axially upward and/or downward movement of the leveling member 370.

The end of the leveling member 370 opposite the head 372 may include the tool receiving portion 376. The tool receiving portion 376 may be analogous to the tool receiving region 76. The tool receiving portion 376 may be a cutout, recess or other opening in the end of the leveling member 370 for receiving a tool therein to cause rotation of the leveling member 370. In some embodiments, the tool receiving portion 376 may be a protrusion from the end of the leveling member 370. The tool receiving portion 376 may be accessed through the attachment opening 314 of the grate 310. In some embodiments, the tool receiving portion 376 may be accessed through the openings 309 of the cover 305. The tool receiving portion 376 may be a square, hexagonal or other shaped recess or protrusion configured to receive a complementary-shaped tool, such as an Allen wrench, therein or thereon for rotation of the leveling member 370. Thus, the apparatus 300 may include a plurality of the leveling members 370, each of the plurality of leveling members 370 comprising a shaft 374 having a head 372 at a first end and the tool receiving portion 376 at a second end, the shaft 374 at least partially threaded, the head 372 including the end portion 373 having a width greater than the width of a channel of the plate 380, each shaft 374 of the leveling members 370 configured to threadingly engage the threads of the vertical bore of the respective locking block 352 with the end portion 373 positioned between the bottom 337 and the plate 380 to axially secure the leveling member 370 within the receiving area 334.

The apparatus 300 may include the plate 380. The apparatus 300 may include a plurality of the plates 380. Each plate 380 may be configured to be secured within one of the plurality of receiving areas 334 axially offset from the bottom 337. As shown, the plate 380 is a flexible clip that is separate from the housing 300 and can be installed or assembled with the housing 330, as described herein. The plate 380 may comprise a channel therethrough having a first width. Thus the plate 380 may be analogous to a plate 480, further detail of which is shown and described herein, for example with respect to FIG. 17D.

The plate 380, for example a clip, may be located and secured within the space between the ribs 335 of the housing 330. The plate 380 may be a separate part that is assembled with the apparatus 300. The plate 380 may snap into place within grooves of the housing wall 333 and/or in the ribs 335. When installed, the plate 380 may be offset from the bottom 337 of the shaft 334, for example with enough space between the plate 380 and the bottom 337 to receive a portion of the head 372 of the leveling member 370, such as the end portion 373. The plate 380 may include a cutout or channel (see the plate 480 in FIG. 17D), for example a radial groove, that is configured to receive therein the reduced-diameter middle portion 375 of the leveling member head 372, for example to prevent or reduce axial movement of the leveling member 370. The enlarged-diameter end and bottom portions 373, 377 of the leveling member head 372 may contact the plate 380 and thereby prevent the leveling member 370 from moving axially. In some embodiments, the plate 380 may be integral to the apparatus 300, such as with the housing 330. Thus, the plate 380 may be analogous to other plates described herein, such as the plates 80, 180, 280. Thus, in some embodiments the plate 380 may be stationary, e.g. fixedly connected to the housing 330.

The apparatus 300 may be assembled with a variety of approaches. The following is one example embodiment of assembly. Other approaches may be used. In some embodiments, the plates 380 may be coupled with the housing 330 within or above the bottoms 337. Next, the leveling members 370 may be coupled with the plates 380, for example by radially inserting the heads 372 of the leveling members 370 into corresponding plates 380. In some embodiments, the leveling members 370 may first be coupled with corresponding plates 380, and then the leveling member 370 and plate 380 combination may be radially inserted above the corresponding bottom 337.

The frame 350 may then be placed over the housing 330, with the tool receiving portions 376 of the leveling members 370 located underneath corresponding locking blocks 352. A tool, such as an Allen wrench, may be inserted through the actuation apertures 360 of the locking blocks 352 and into the tool receiving portions 376 of the leveling members 370. The leveling member 370 may then be rotated and threadingly engage the threads 362 of the corresponding actuation aperture 360. Rotation of the leveling members 370 will adjust the leveling frame 350 and thereby the grate 310 relative to the housing 330 and the leveling members 370 will remain axially stationary relative to the housing 330. The plate 380 will prevent upward (and downward) movement of the leveling member 370, and thus the frame 350 will move up or down over the leveling member 370 as the leveling member 370 rotates. One leveling member 370 may be rotated at a time. In some embodiments, more than one leveling member 370 may be rotated at the same time. In some embodiments, the leveling members 370 may be rotated individually and cyclically. For example, a first leveling member 370 may be rotated so that the frame 350 partially moves down over the first leveling member 370, and then a second leveling member 370 may be rotated so that the frame 350 partially moves down over the second leveling member 370, etc. In this manner, the leveling members 370 may each be partially rotated until the frame 350 has moved down to the desired height. This may prevent, for example binding of portions of the frame 350, such as the fin 354, with portions of the housing 330, such as the channel 340. The orientation of the grate 310 may be adjusted by making finer adjustments to the leveling members 370, as further described.

Next, for example, the holder 361 may be placed on top of the frame 350, and the grate 310 in turn may be placed on top of the holder 361. Fasteners may be used to secure the holder 361 and grate 310 to the frame 350. In some embodiments, the holder 361 and grate 310 may be secured the frame 350 prior to securing the frame 350 to the housing 330, as described above. The fasteners may be inserted through the attachment opening 312 of the grate 310, through the opening 364 of the holder 361, and into the opening 356 of the frame 350, as described above. Thus, the grate 310 may be fixedly attached to the frame 350 such that adjustment of the frame 350 causes corresponding adjustment of the grate 310. For example, upward or downward movement or tilting of the frame 350 will cause a similar upward or downward movement or tilting of the grate 310.

Next, for example, the cover 305 may be secured to the apparatus 300 over the grate 310. The lip 306 of the cover 305 may attach to outer portions of the apparatus, such as the outer sides and/or edges of the grate 310, the holder 361, and/or the frame 350. The lip 305 may flex outward to create a friction fit over the corresponding features of the apparatus 300. The attachment 307 may couple with the opening 311 of the grate 310, as described above. The attachment 307 may flex inward to create a friction fit with the opening 311.

Next, for example, the housing 330 may be secured to the collar 320. In some embodiments, the housing 330 may be secured to the collar 320 prior to connecting the frame 350, etc. to the housing 330. In some embodiments, the collar 320 may first be secured to a pipe or pipe adapter. The collar 320 may surround the pipe end or fit within the pipe end. The housing 330, either alone or with one or more other parts of the apparatus 300, may be secured to the collar 320, either before or after the collar 320 is secured to the pipe end or pipe adapter. The housing 330 may rotatably couple with the collar 320. For example, outer threads of the lower wall 331 may engage with inner threads of the collar 320. This is merely an example and other approaches may be used for connecting the housing to the collar 320. In some embodiments, the collar 320 may be integral with the housing 330. In some embodiments, the housing 330 may couple directly with the pipe end or pipe adapter.

The apparatus 300 may be adjusted by adjustment of the leveling members 372. The apparatus 300 may be adjusted either before or after integration with the collar 320 and/or pipe. A single leveling member 372 can be adjusted by inserting a tool into the tool receiving portion 376 of the leveling member 370, as described. Rotation of the tool may cause rotation of the corresponding leveling member 370. Rotation of the leveling member 370 in a first direction, for example clockwise or counterclockwise, may cause relative movement between the leveling member 370 and the frame 350. For example, the threads 362 of the actuation aperture may mechanically communicate with threads of the shaft 374 of the leveling member 370. The plate 380 and bottom 337 will prevent axial movement of the leveling member 370 in both directions. Thus, as the leveling member 370 rotates, the threads will interact such that the frame 350 will either move up or down (depending on the direction of rotation of the leveling member 370) while the leveling member 370 will remain stationary. In some embodiments, the leveling member 370 may move slightly in the axial direction either up or down. For example, there may be some play or gaps between the plate 380 and the end and bottom portions 373, 377 of the head 372 of the leveling member 370, allowing for slight movement of the leveling member 370 up or down.

There may be three leveling members 372. In some embodiments, there may be fewer or more than three leveling member 372. Thus, movement of one leveling member 370 as described may result in axial movement of the corresponding portion of the frame 350. For example, the frame 350 may be oriented at an angle after adjustment of one leveling member 370. One or more of the remaining leveling members 370 may be similarly adjusted to further move the frame 350, and thus the grate 310, to the desired orientation. The leveling members 372 may be spaced angularly equally apart. For example, there may be three leveling members 372 each spaced one hundred twenty degrees apart from each other. Thus, the corresponding movement of a single leveling member 370 may have a corresponding effect on the angular orientation of the grate 310. Adjustment of all leveling members 370 similar amounts may result in maintaining the angular orientation of the grate 310 but locating it farther upward or downward. For example, the grate 310 may be flat before adjustment and then flat after adjustment of all three leveling members 370 the same amount. If an angled grate 310 is desired, the leveling members 370 may be adjusted different amounts. For example, only one or two of the three leveling members 370 may be adjusted. Thus, a variety of adjustments to the grate 310 may be implemented. Further, fewer or more than three leveling members 370 and the associated features may be incorporated as well, for example for finer adjustment of the grate 310. Further, the leveling members 370 and corresponding locking blocks 352 with actuation apertures 360, and/or other features of the apparatus 300, may be in a variety of different locations, e.g. angularly about the axis and/or radially toward the axis, and thus a variety of different adjustments may be implemented depending on the configuration of the apparatus 300.

Figure 17A:
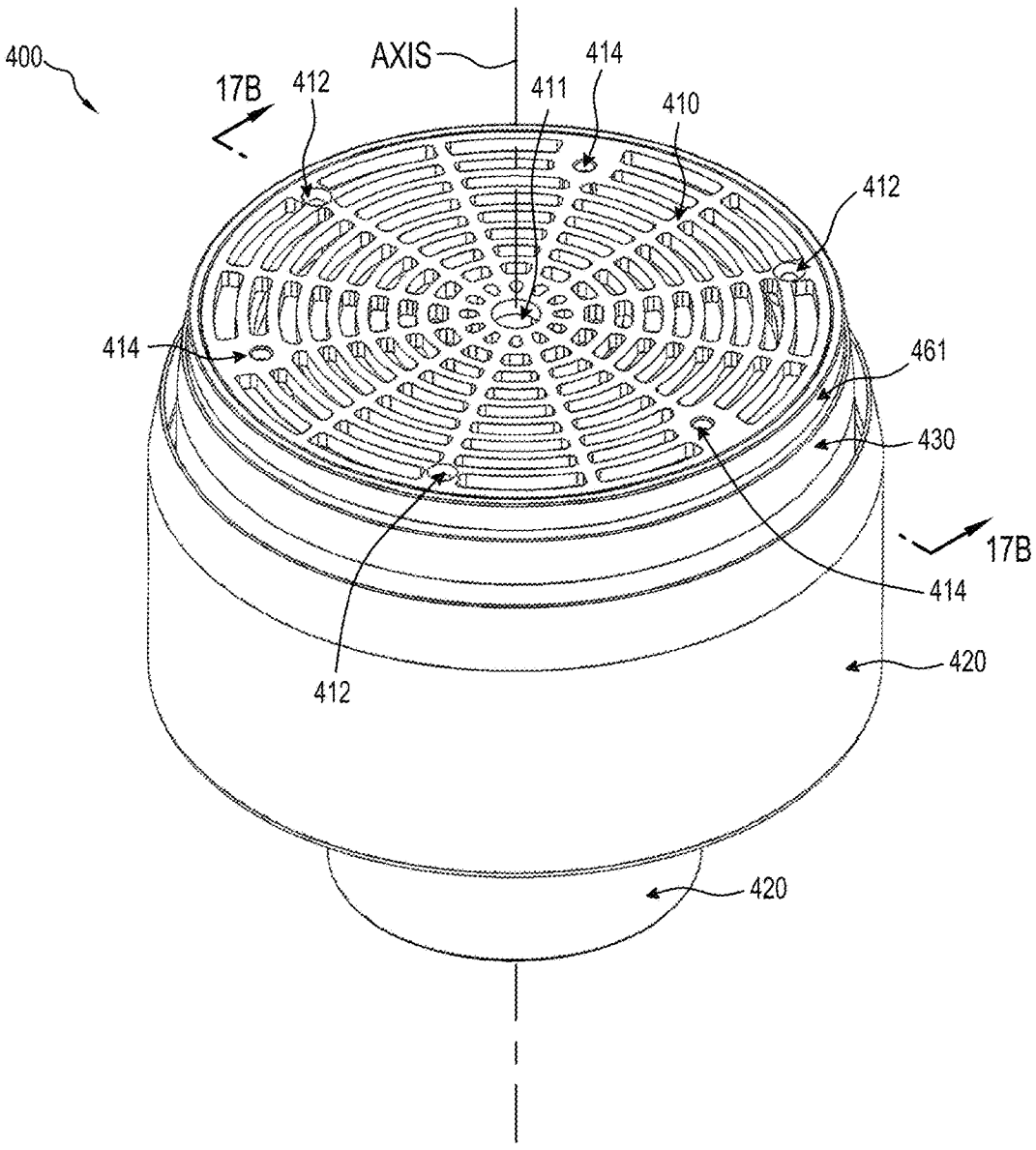
FIGS. 17A-17D are various views of another embodiment of an adjustable drain apparatus.
Figure 17B:
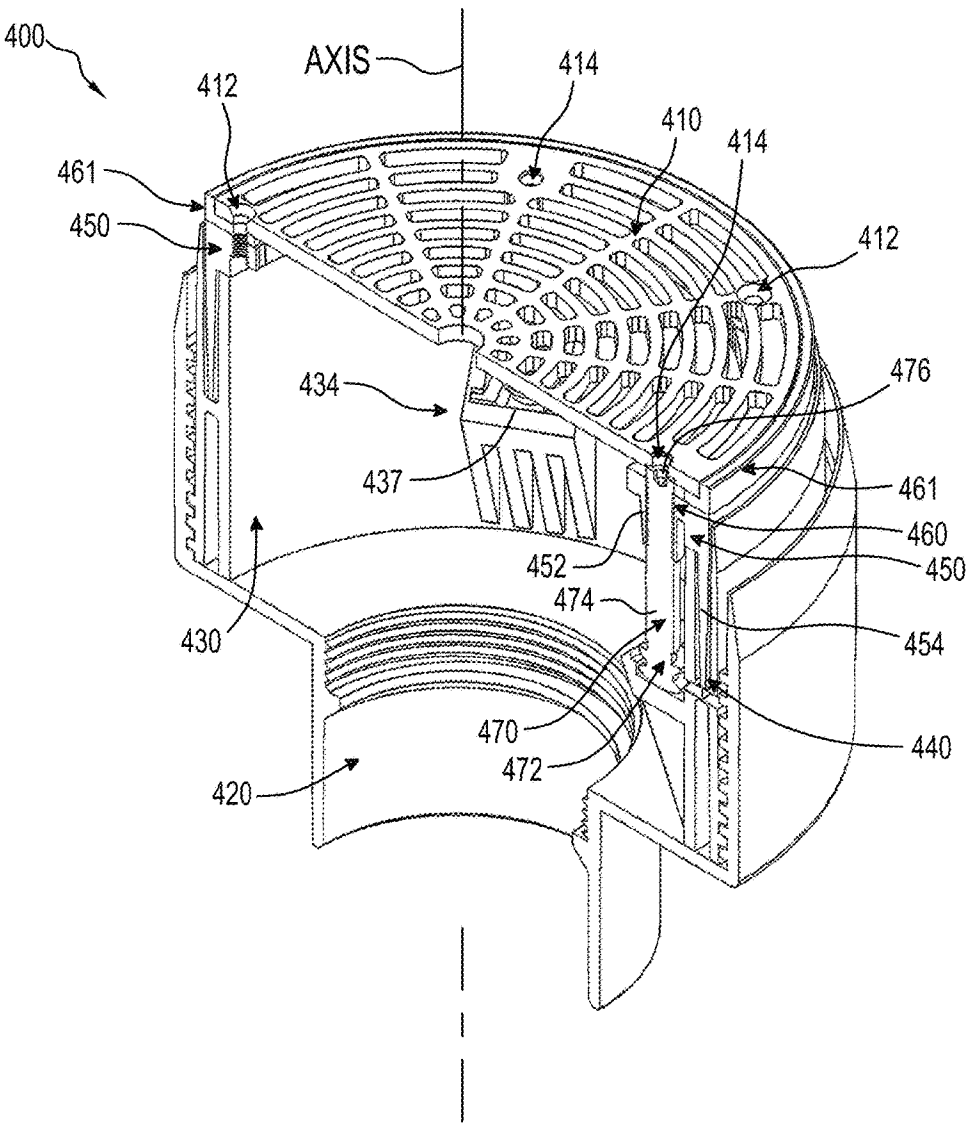
Figure 17C:
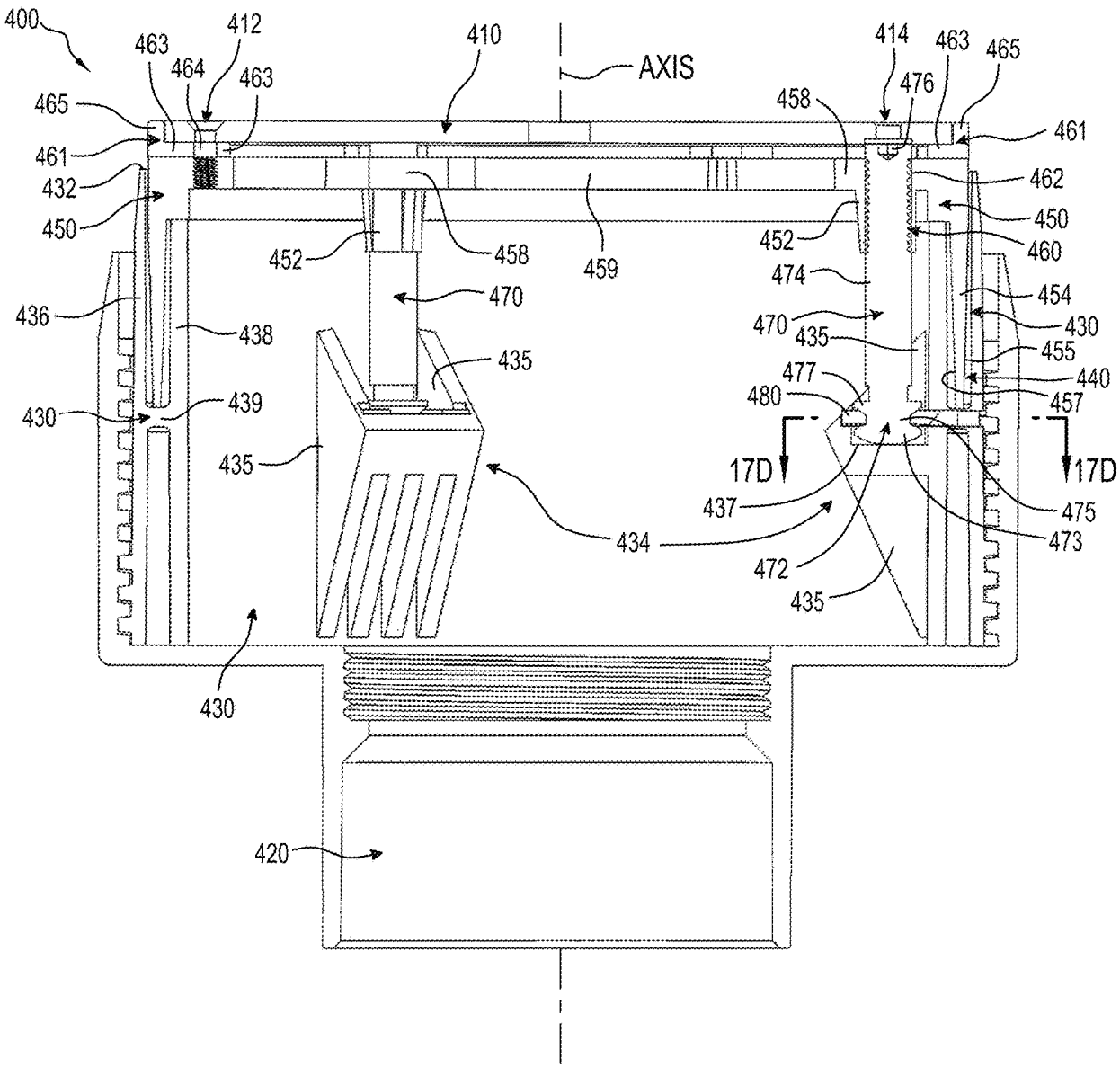
Figure 17D:
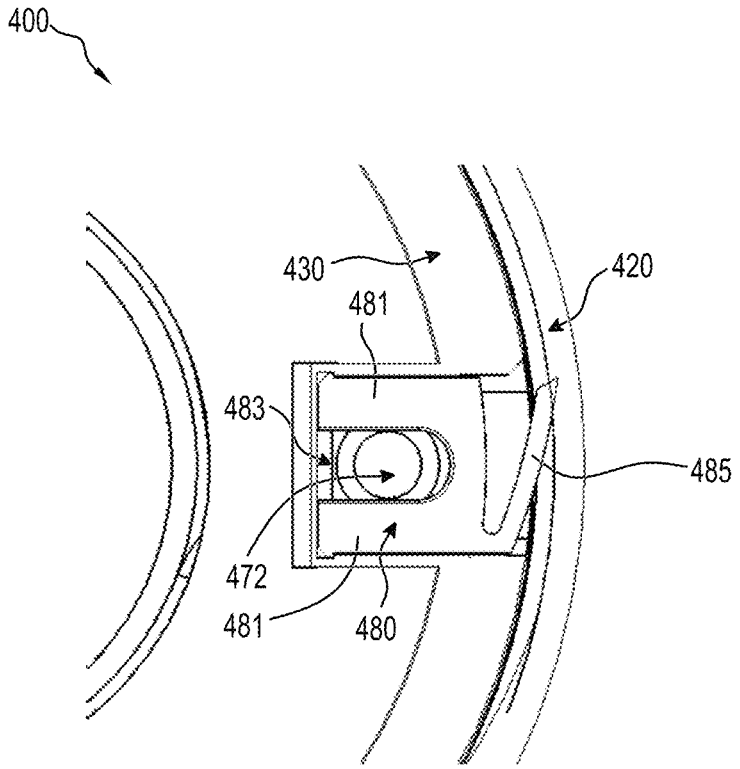

FIGS. 17A-17D are various views of another embodiment of an adjustable drain apparatus 400. FIG. 17A is a perspective view of the apparatus 400 and FIGS. 17B and 17C are cross-section views of the apparatus 400 as taken along the line 17B-17B indicated in FIG. 17A. FIG. 17D is a partial cross-section view of the apparatus 400 as taken along the line 17D-17D as indicated in FIG. 17C. In addition or alternatively to the description below, the apparatus 400 may be analogous to other drain apparatuses described herein, such as the apparatuses 100, 100', 100" and/or 300.

Referring to FIG. 17A, the apparatus 400 may include a grate 410, a collar 420, a raising core or housing 430, and/or a holder 461. The grate 410, a collar 420, housing 430, and holder 461 may be analogous to the grate 310, a collar 320, housing 330, and holder 361, respectively. In addition, the apparatus 400 may include a cover (not shown for clarity), which may be analogous to the cover 305. The grate 410 may include an opening 411 and attachment openings 412 and 414, which may be analogous to the opening 311 and the attachment openings 312 and 314.

Referring to FIGS. 17B and 17C, the apparatus 400 may include the collar 420. The collar 420 may include a reduced-diameter section below an enlarge-diameter section, as shown. Internal threads of the upper portion of the collar 420 may provide an engagement feature for the housing 430. In some embodiments, the collar 420 may include internal threads in the lower reduced-diameter section, as shown.

The apparatus 400 may include the housing 430. The housing 430 may include an outer wall 436 and an inner wall 438. The outer wall 436 may be analogous to the outer wall 336. The outer wall 436 may include threads that engage with internal threads of the collar 420. The inner wall 438 may be analogous to the upper wall 333. Thus the outer and inner walls 436, 438 may form a channel 440, which may be analogous to the channel 340. In addition, the outer and inner walls 436, 438 may extend below the channel 440, as shown. The outer and inner walls 436, 438 may extend to or near the bottom of the increased-diameter section of the collar 420. Threads on the outside of the outer wall 436 may extend along the entire length of the outer wall 436, or they may partially extend therealong. An element 439 may connect the outer and inner walls 436, 438. The element 439 may extend radially as shown and in between the outer and inner walls 436, 438. The element 439 may in part define the channel 440. A lower space below the element 439 may be created, such as a lower channel similar to the channel 440, or in some embodiments this lower space may be filled in. The element 439 may extend circumferentially around the axis, either continuously or discontinuously, for example below the channel 440.

The housing 430 may include an upper tip or edge 432 and one or more receiving shafts 434 having one or more ribs 435 and bottoms 437, which may be analogous to the upper edge 332 and receiving shafts 334 having ribs 335 and bottoms 337, respectively. As shown, the ribs 435 may extend below corresponding bottoms 437.

The apparatus 400 may include a leveling frame 450. The frame 450 may be analogous to other leveling frames described herein, such as the frames 50, 150, 250 and/or 350. The frame 450 may include a shield or fin 454, which may be analogous to other fins described herein, such as the fin 54 and/or 354. The fin 454 may be received into the channel 440.

The frame 450 may include one or more locking blocks 452, which may be analogous to other locking blocks described herein, such as the locking blocks 52, 152 and/or 352. The locking blocks 452 may extend axially downward as oriented for a shorter length as compared to the locking blocks 352.

The frame 450 may include one or more internal flanges 458 and/or an inner ring 459, which may be analogous to the internal flanges 358 and inner ring 359, respectively. The locking blocks 452 may extend from corresponding flanges 458 of the frame 450. The ring 459 may include openings 456, which may be analogous to the openings 356.

The frame 450 may include one or more actuation apertures 460 having internal threads 462. The actuation aperture 460 may be analogous to other actuations apertures described herein, such as the actuation aperture 60, 160, 260 and/or 360. The apertures 460 may receive a leveling member 470, as further described, which may engage with the threads 462.

The apparatus 400 may include a strain holder 461 having a flange 463, a lip 465 and openings 464, which may be analogous to the holder 361 having the flange 363, lip 365 and openings 364.

The apparatus 400 may include one or more leveling members 470, which may be analogous to the leveling members 70, 170 and/or 370. The leveling member 470 may include a head 472 and shaft 474 with a tool receiving portion 476, which may be analogous to the other heads and shafts of leveling members described herein, for example the heads 72, 172, 372 and shafts 74, 174, 374 respectively. The head 472 of the leveling member 470 may include an end portion 473, a middle portion 475 and a bottom portion 477, which may be analogous to the end portion 373, the middle portion 375 and the bottom portion 377. The space created by the differences in relative diameters of the end, middle and bottom portions 473, 475, 477 may receive a plate 480 therein, as further described, for preventing axially upward and/or downward movement of the leveling member 470. The plate 480 may be analogous to the plate 380. Further detail of the plate 480 is described herein, for example with respect to FIG. 17D.

The apparatus 400 may be assembled with a variety of approaches, such as those described herein with respect to assembly of the apparatus 300. The apparatus 400 may be adjusted by adjustment of the leveling members 472, for example similar to adjustment of the leveling members 372 as described with respect to the apparatus 300.

Referring to FIG. 17D, an embodiment of the plate 480 installed in the apparatus 400 is shown. The plate 480 may include two prongs 481 extending (when assembled) radially inward as shown. The prongs 481 may define a channel 483, which may be a radial groove in the plate 480. The plate 380 may comprise the channel 483 therethrough having a first width, which may be smaller than a second width of the end portion 373 of the leveling member 370. The channel 483 may receive therein the reduced-diameter middle portion 475 of the leveling member head 472, for example to prevent or reduce axial movement of the leveling member 470. The enlarged-diameter end and bottom portions 473, 477 of the head 472 may contact the prongs 481, and/or other portions of the plate 480, and thereby prevent the leveling member 470 from moving axially. The plate 480 may include flexible tab 485 extending radially outward therefrom (when installed). The tab 485 may flex outward and thereby bias the plate 480 radially inward. The plate 480 may sit within a groove or space above the bottom 437 and/or in between surrounding ribs 435. The plate 480 may be biased to stay in that position by the tab 485 pressing against other features of the apparatus 400, such as the collar 420 or housing 430. The plate 480 may be formed of metal, alloy, plastic, polymer, composites, other suitable materials, or combinations thereof. The plate 480 may be analogous to the plate 380 and/or plate 580, which is further described herein.

Figure 18A:
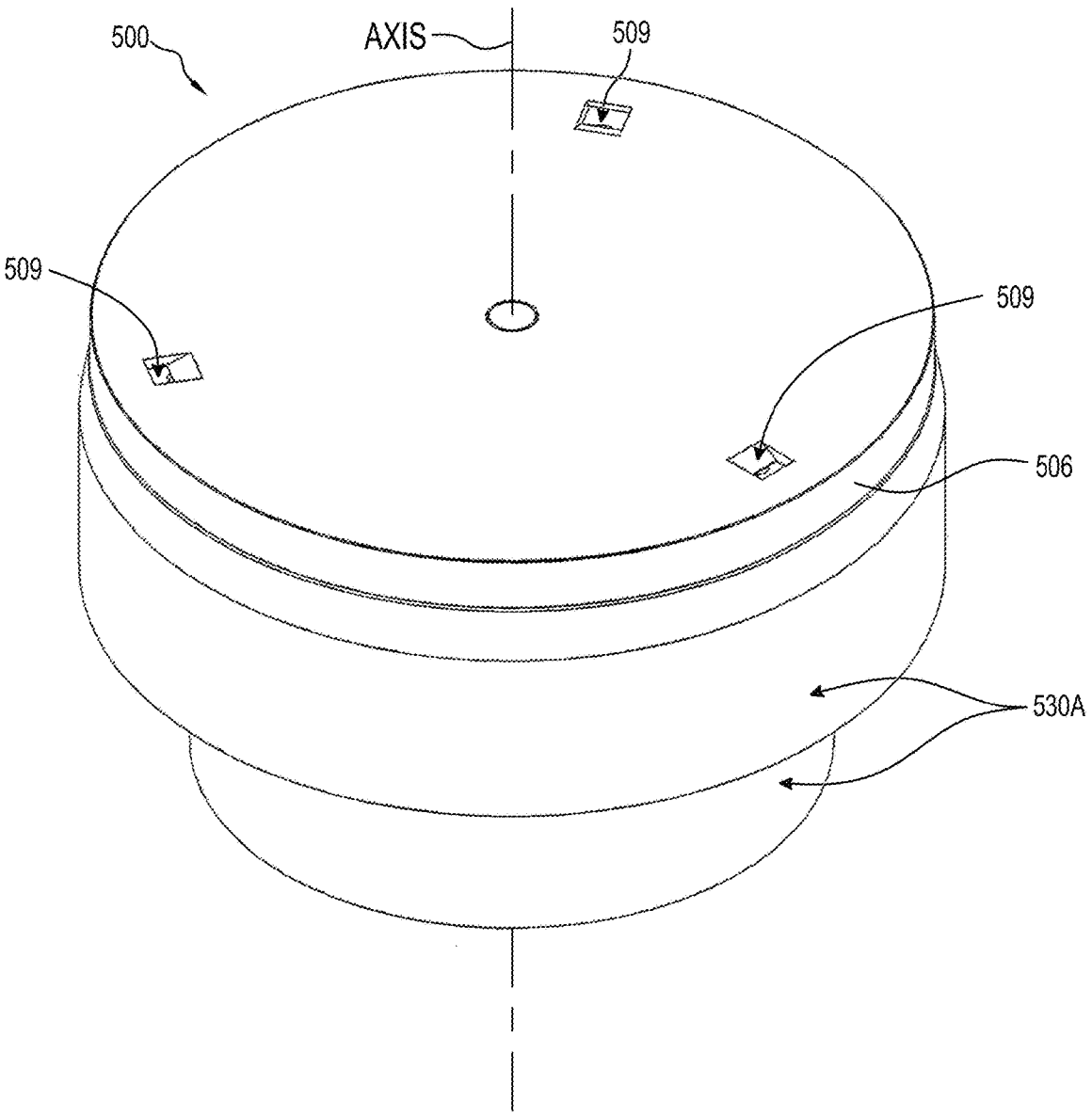
FIGS. 18A-18C are various views of another embodiment of an adjustable drain apparatus.
Figure 18B:
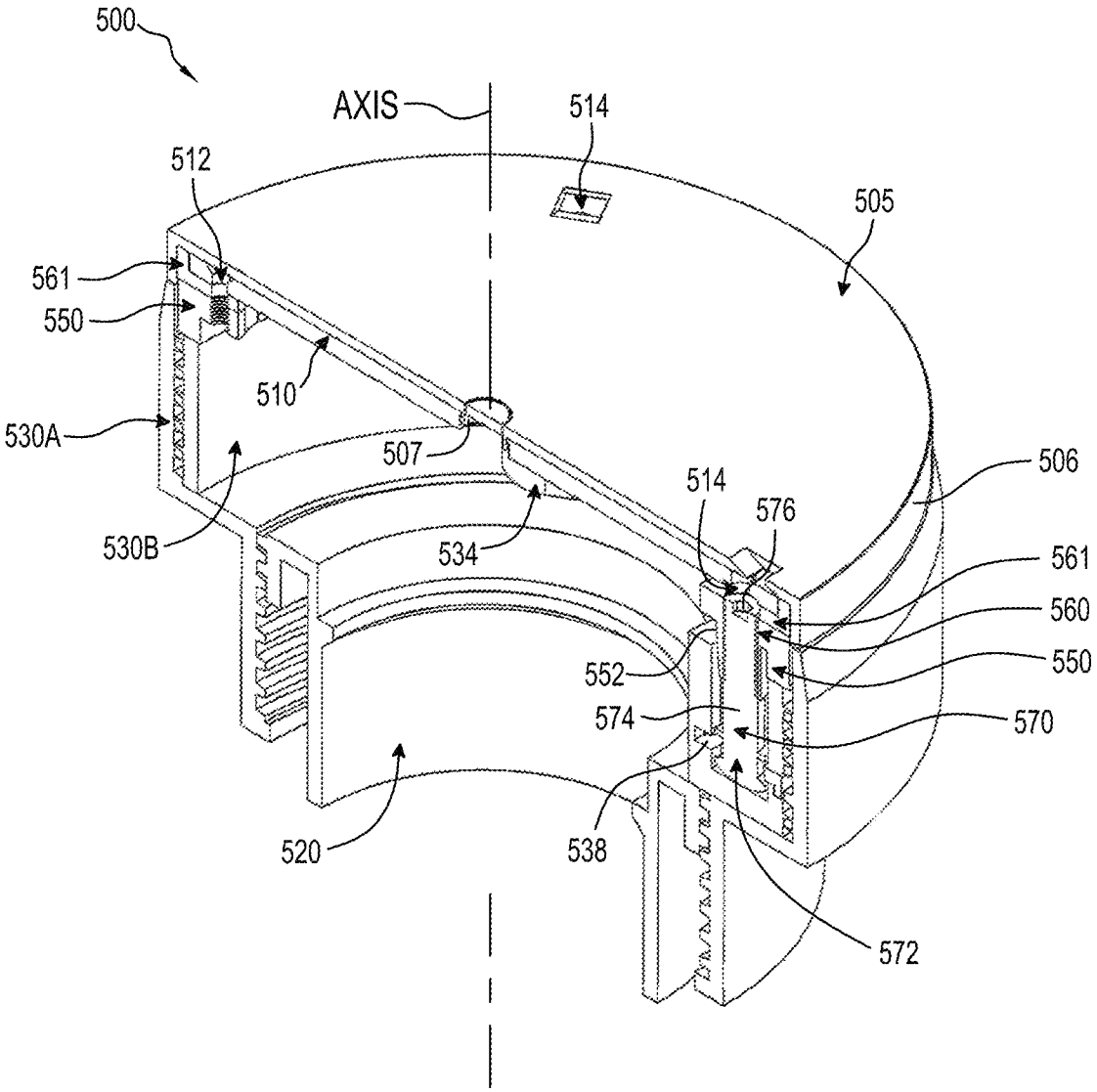
Figure 18C:
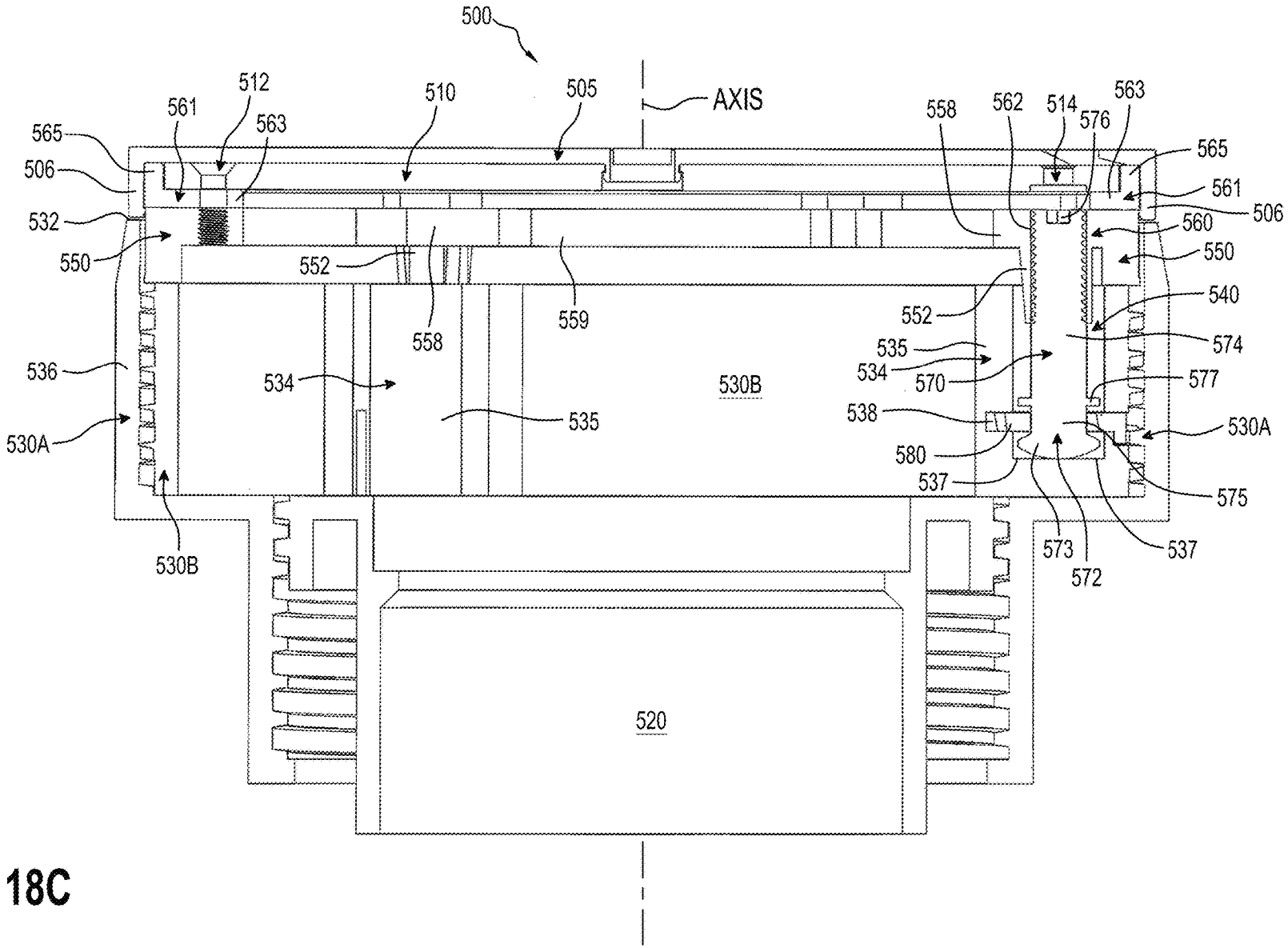

FIGS. 18A-18C are various views of another embodiment of an adjustable drain apparatus 500. FIG. 18A is a perspective view of the apparatus 500 and FIGS. 18B and 18C are cross-section views of the apparatus 500 as taken along the line 18B-18B as indicated in FIG. 18A. In addition or alternatively to the description below, the apparatus 500 may be analogous to other drain apparatuses described herein, such as the apparatuses 100, 100', 100", 300 and/or 400.

Referring to FIG. 18A, the apparatus 500 may include a cover 505 and an outer raising core or outer housing 530A, and/or a holder 461. The cover 505 and outer housing 530A may be analogous to the cover 305 and housings 330, 430, respectively. The cover 505 may include a lip 506, attachment 507, and openings 509, which may be analogous to the lip 306, attachment 307 and openings 309, respectively.

Referring to FIGS. 18B and 18C, the apparatus 500 may include a grate 510, a collar 520, an inner housing 530, a holder 561, and a frame 550, which may be analogous to the grates 310, 410, the collars 320, 420, the housings 330, 430, the holders 361, 461, and the frames 350, 550, respectively. The grate 510 may include an opening 511 and attachment openings 512 and 514, which may be analogous to the openings 311, 411 and the attachment openings 312, 412 and 314, 414, respectively.

The collar 520 may include a cylindrical section having an outward extend flange and downward extending lip at the upper end, as shown. External threads of the lip of the collar 520 may provide an engagement feature for the outer housing 530A. In some embodiments, the collar 520 may include an internal lip, as shown, for example to butt up against a drain pipe.

The apparatus 500 may include the outer and inner housings 530A, 530B. The outer housing 530A may include an outer wall 536 forming a reduced diameter section below an increased-diameter section, as shown. In some embodiments, the diameters may be the same or the relation reversed. The outer wall 536 may have an edge 532 and may be analogous to the outer walls 336, 436 having edges 332, 432. The outer wall 536 may include internal threads that engage with external threads of the inner housing 530B. The outer housing 530A may be adjustable, for example it may ride on the collar 520.

The inner housing 530B may have a circumferential outer wall, e.g. cylindrical or generally cylindrical, that may be analogous to the upper wall 333. The inner housing 530B may be adjustable, for example it may adjust on the outer housing 530A. The inner housing 530B may carry the frame 550 that can be adjusted, as further described. The inner housing 530B may include one or more receiving areas or receiving shafts 534 which may be analogous to the receiving shafts 334, 434. The receiving shaft 534 may include a bottom 537, which may be analogous to the bottoms 337, 437. The receiving shaft 534 may include a wall 535 extending circumferentially to define a local axis and/or opening therein, such as a receiving channel 540. The wall 535 may extend to the bottom 537. The wall 535 may have a variety of other shapes, including square, rectangular, segmented, etc. The wall 535 may be closed off on the sides as shown or it may have side openings.

The inner housing 530B may include the one or more receiving shafts 534 each defining a receiving channel 540 therein. The receiving channel 540 may be analogous to the channel 40. The receiving channels 540 may receive therein corresponding locking blocks 552, as further described. The channels 540 may each include a groove 538 and one of the bottoms 537 located at or near the bottoms thereof. The channels 540 may each receive a corresponding plate 580, which may be analogous to the plates 380, 480. The grooves 538 may be radially outward spaces or recesses within the channels 540 configured to receive an expanded plate 580 therein, as further described. The grooves 538 may be located above the bottoms 537.

The apparatus 500 may include a leveling frame 550. The frame 550 may be analogous to other leveling frames described herein, such as the frames 50, 150, 250, 350 and/or 450. The frame 550 may sit on top of the inner housing 530B, either directly or with intermediate structures, fittings, etc. As the frame 550 is adjusted, the frame 550 may move relative to the inner housing 530B.

The frame 550 may include one or more locking blocks 552, which may be analogous to other locking blocks described herein, such as the locking blocks 52, 152, 352 and/or 452. The locking blocks 552 may extend axially downward as oriented for a shorter, longer or similar length as compared to the locking blocks 352, 452. The locking blocks 552 may extend into the corresponding receiving channel 540. In some embodiments, the locking blocks 552 may not extend into the corresponding receiving channel 540.

The frame 550 may include one or more internal flanges 558 and/or an inner ring 559, which may be analogous to the internal flanges 358, 458 and inner rings 359, 459, respectively. The locking blocks 552 may extend from corresponding flanges 558 of the frame 550. The ring 559 may include openings 556, which may be analogous to the openings 356, 456.

The frame 550 may include one or more actuation apertures 560 having internal threads 562. The actuation aperture 560 may be analogous to other actuations apertures described herein, such as the actuation aperture 60, 160, 260, 360 and/or 460. The apertures 560 may receive a leveling member 570, as further described, which may engage with the threads 562.

The apparatus 500 may include a strain holder 561 having a flange 563, a lip 565 and openings 564, which may be analogous to the holders 361, 461 having the flanges 363, 463, lips 365, 465 and openings 364, 464, respectively.

The apparatus 500 may include one or more leveling members 570, which may be analogous to the leveling members 70, 170, 370 and/or 470. The leveling member 570 may include a head 572 and shaft 574 with a tool receiving portion 576, which may be analogous to the other heads and shafts of leveling members described herein, for example the heads 72, 172, 372, 472 and shafts 74, 174, 374, 474, respectively. The head 572 of the leveling member 570 may include an end portion 573, a middle portion 575 and a bottom portion 577, which may be analogous to the end portion 573, the middle portion 575 and the bottom portion 577. The bottom portion 577 may be a flange or radially outward lip as shown. The space created by the differences in relative diameters of the end, middle and bottom portions 573, 575, 577 may receive the plate 580 therein, as further described, for preventing axially upward and/or downward movement of the leveling member 570. The plate 580 may be analogous to the plates 380, 480.

The apparatus 500 may be assembled with a variety of approaches, such as those described herein with respect to assembly of the apparatuses 300, 400. The housings 530A, 530B of the apparatus 500 may be assembled differently from the apparatuses 300, 400. For example, the outer housing 530A may be threaded onto the collar 520 and then the inner housing 530B may be threaded into the outer housing 530A, or vice versa. Further, for example, the plates 580 may be inserted axially into the channels 540 and secured inside the grooves 538 within the channels 540. The plates 580 may be compressed to fit within the channel 540 and then expand into the groove 538 to secure therein. The leveling members 570 may be inserted axially into the channels 540, either before or after engagement with the locking blocks 552.

The apparatus 500 may be adjusted by adjustment of the leveling members 570, for example similar to adjustment of the leveling members 372, 472 as described with respect to the apparatuses 300, 400. Thus the frame 550, and therefore the grate 510, may translate, rotate, etc. to a desired orientation by selective rotation of one or more of the leveling members 570.

Figure 19:
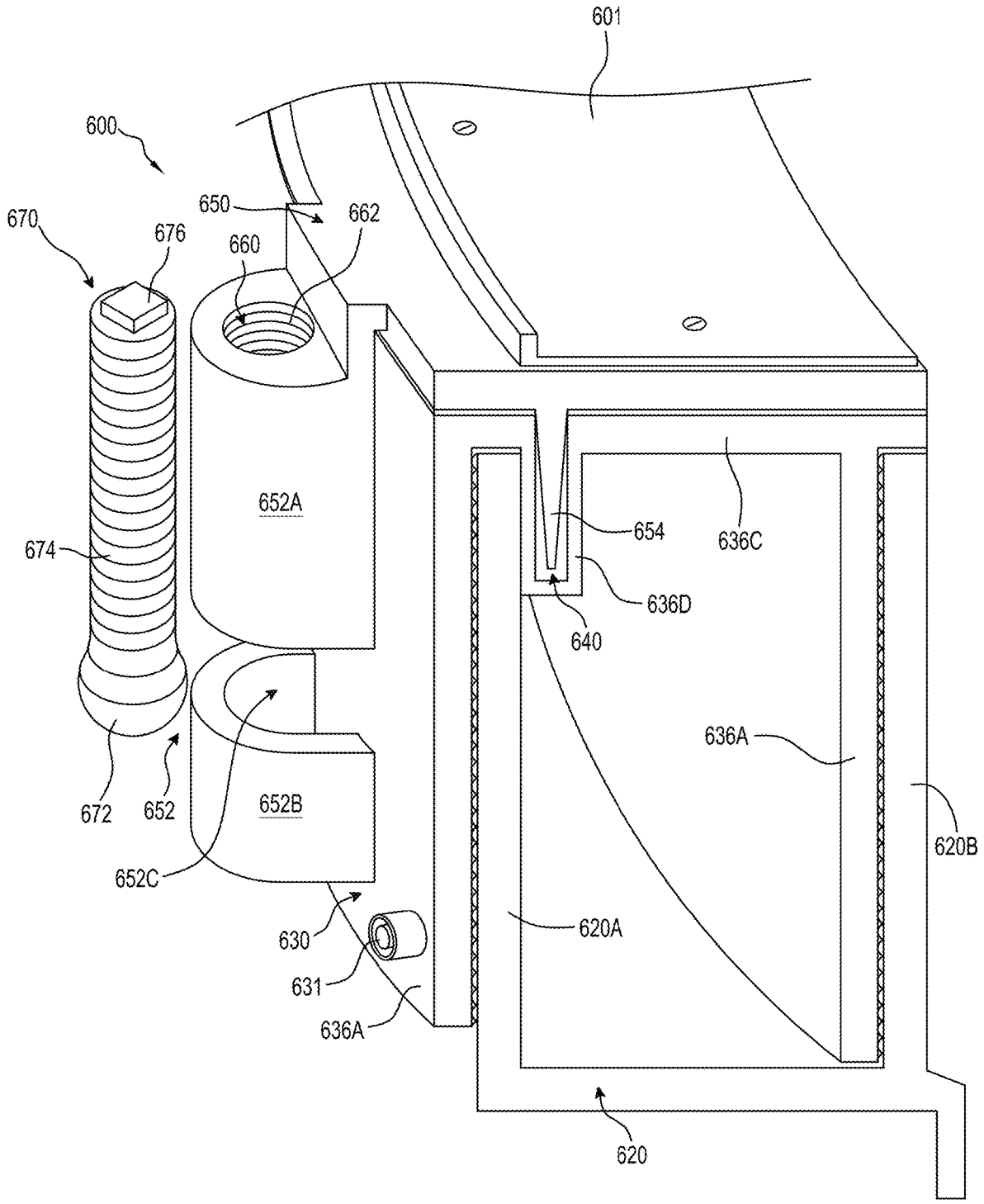
FIG. 19 is a partial cross-section view of an embodiment of an adjustable apparatus that may be used with drains and/or other waste handling devices connected to a sewer or drain conduit, such as manholes, etc.

FIG. 19 is a partial cross-section view of an adjustable apparatus 600 that may be used with adjustable drains or other apparatuses, such as manhole covers, etc. In addition or alternatively to the description below, the apparatus 600 may be analogous to other adjustable apparatuses described herein, such as the apparatuses 100, 100', 100", 300, 400, 500 and/or 700.

The apparatus 600 may include a collar 620 and a housing 630, which may be analogous to the collars and housings described herein, for example the collars 320, 420, 520 and housings 330, 430, 530, respectively. The collar 620 may couple with a manhole riser or other feature. In some embodiments, the collar 620 may be a manhole riser. The collar 620 may include an outer wall 620A and an inner wall 620B. The outer and inner walls 620A, 620B may have external threads on outer surfaces thereof.

The housing 630 may include an outer wall 636A and an inner wall 636B. The outer and inner walls 636A, 636B may extend axially downward from a top portion 636C. The outer and inner walls 636A, 636B may have internal threads on inner surfaces thereof. The outer and inner walls 636A, 636B may engage the outer and inner walls 620A, 620B of the collar 620, respectively. Other mechanical features may be used for securing the collar 620 to the housing 630, such as friction fit, threads on only one or the other wall 636A, 636B, latches, plates, etc. The housing 630 may include a stop 631. The stop 631 may be a spring-loaded pin extending through the outer wall 636A and biased to move toward the outer wall 620A of the collar 620. The outer wall 620A may include an inward recess on an outer surface thereof, or an opening extending therethrough, at a particular location along the threads of the outer wall 620. The stop 631 may be received into the recess or opening of the outer wall 620A and thereby prevent further rotation of the housing 630 relative to the collar 620. The stop 631 may be retracted to farther thread the two parts, either in the reverse direction or continuing the same direction for example to separate the housing 630 and collar 620. The stop 631 may be used to limit upward movement of the housing 630 relative to the collar 620. For example, for uses of the apparatus 600 involving heavy and/or large features with large weights, such as manhole risers etc., there may be a minimum thread engagement required between the housing 630 and the collar 620. The location of the recess or opening that receives the stop 631 may be located along the thread grooves, for example threads of the outer wall 620A, to ensure adequate thread engagement to support the weight of the housing 630. The stop 631 therefore provides a limit to rotation and acts as a warning for assemblers of the apparatus 600 against further disengagement of the housing 630 from the collar 620.

The housing 630 may include a channel 640 defined by wall 636D. The wall 636D may form an opening that defines the channel 640 therein, which may be open at the top. The wall 636D may extend downward from the top portion 636C, across at a lower portion thereof, and back up to the top portion 636C. The wall 636D may extend downward farther or shorter than is shown in the figure. In some embodiments, the channel 640 may allow for portions of a frame 650 to move therein, as further described. The wall 636D and outer wall 636A may define a space therebetween in which the outer wall 620A of the collar 620 is received, as shown. This may be a friction or interference fit, or there may be no interference. In some embodiments, the radially outer surface of the wall 636D that faces the outer wall 636A may include outer threads that engage inner threads of the outer wall 620A.

The apparatus 600 may include a locking block 652. The locking block 652 may be composed of an upper locking block segment 652A and a lower locking block segment 652B. The housing 630 may include the lower locking block segment 652B. The segment 652B may be attached to the outside of the outer wall 636A. The segment 652B may include a wall extending radially outward from the outer wall 636A and then radially inward back to the outer wall 636A to form an opening therein. The segment 652B may have an opening at the top, forming an axial or generally axial opening into the segment 652B from the top. The bottom of the segment 652B may be closed, for example with a bottom therein (not visible in the figure), and that may be similar to the bottoms described herein such as the bottoms 337, 437, 537. The segment 652B may receive therein a leveling member 670 or portion thereof.

The apparatus 600 may include the frame 650. The frame 650 may be analogous to the other frames described herein. The frame 650 may sit on top of the housing 630. The frame 650 may include a fin 654 that extends axially downward therefrom. The fin 654 may be analogous to the other fins described herein. The fin 654 may be received into the channel 640 and configured to move within the channel 640 as the frame 650 is adjusted.

The frame 650 may include the upper locking block segment 652A. The segment 652A may be located on the outside of the frame 650. The segment 652A may have a similar outer shape as the lower segment 652B. The segment 652A may include an actuation aperture 660 having internal threads 662. The actuation aperture 660 may be analogous to the other actuation apertures described herein, such as the actuation apertures 60, 160, 260, 360, 460 and/or 560. The segment 652A may be configured to axially align with the lower segment 652B when assembled. The aperture 660 may be aligned with the opening of the lower segment 652B. The aperture 660 of the segment 652A may receive therein the leveling member 670 or portion thereof. There may be multiple segments 652A, 652B located circumferentially around the apparatus 600, for example one, two, three, four, five or more pairs of the segments 652A, 652B.

The apparatus 600 may include one or more of the leveling members 670, which may be analogous to the various leveling members described herein. There may be one leveling member 670 per pair of segments 652A, 652B. The leveling member 670 may include a head 672, shaft 674, and tool receiving portion 676, which may be analogous to other heads, shafts, and tool receiving portions described herein. The shaft 674 may include external threads that engage the internal threads 662 of the aperture 660. The shaft 674 of the leveling member 670 may engage the segment 652A from the bottom so that the head 672 or portion thereof (and possibly part of the shaft 674) protrudes from the bottom of the segment 652A. The head 672 may contact the bottom of the segment 652B. The bottom of the segment 652B may limit and prevent downward axial movement of the leveling member 670 relative to the housing 630. In some embodiments, the head 672 may couple with features of the segment 652B, such as a plate located therein, which may be analogous to other plates described herein, or an inner annular groove of segment 652B allowing for rotation of the head 672 while preventing axial movement. There may be a gap 652C formed in between the segments 652A and 652B when the frame 650 is assembled on top of the housing 630. In some embodiments, the shaft 674 (and possible part of the head 672) may protrude into the gap 652C when assembled. A tool such as a wrench may engage the tool receiving portion 676 and rotate the leveling member 670 inside the aperture 660. The frame 650 may then move up or down due to rotation of the leveling member 670, as described herein. The housing 630 may remain stationary. Thus, the frame 650 may be moved upward or downward relative to the housing 630, for example to remove or install the frame 650 onto the housing 630. A manhole cover 601 or other feature may be attached to the frame 650 such that removal of the frame 650 will cause removal of the manhole cover 601 or other feature. In some embodiments a cover or lid analogous to the other covers described herein, such as the covers 305, 505, may be used with the apparatus 600, for example to cover the entire apparatus 600 or portions thereof such as the housing 630, for instance to bury the apparatus 600 and dig up later. Such cover may be separate and used as a structural cover for the housing 630, and the housing 630 with cover may be dug up after asphalt is installed and then the manhole device/housing 630 may be installed with the remaining portions of the apparatus 600.

Figure 20A:
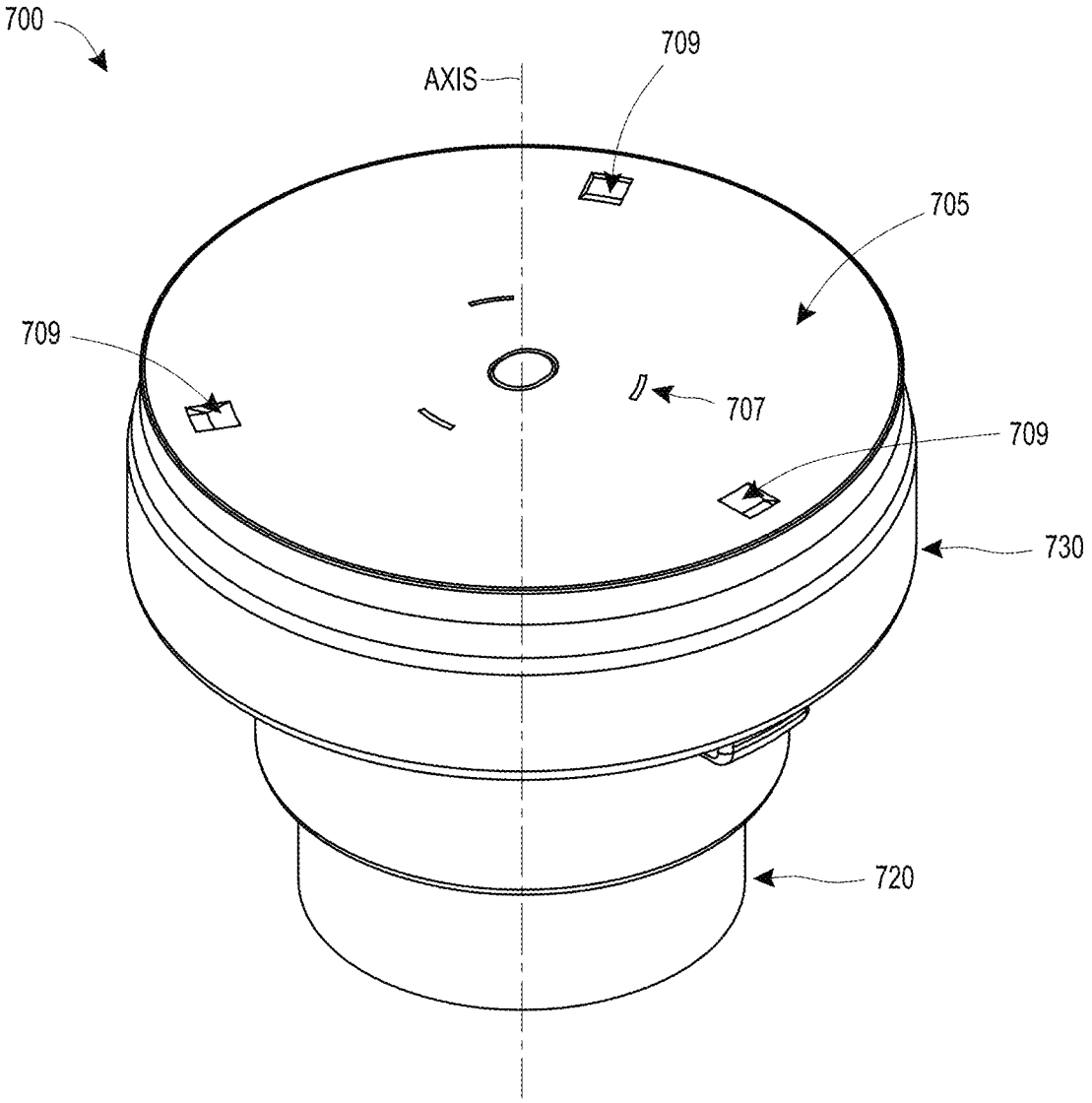
FIGS. 20A-20C are various views of another embodiment of an adjustable drain apparatus.
Figure 20B:
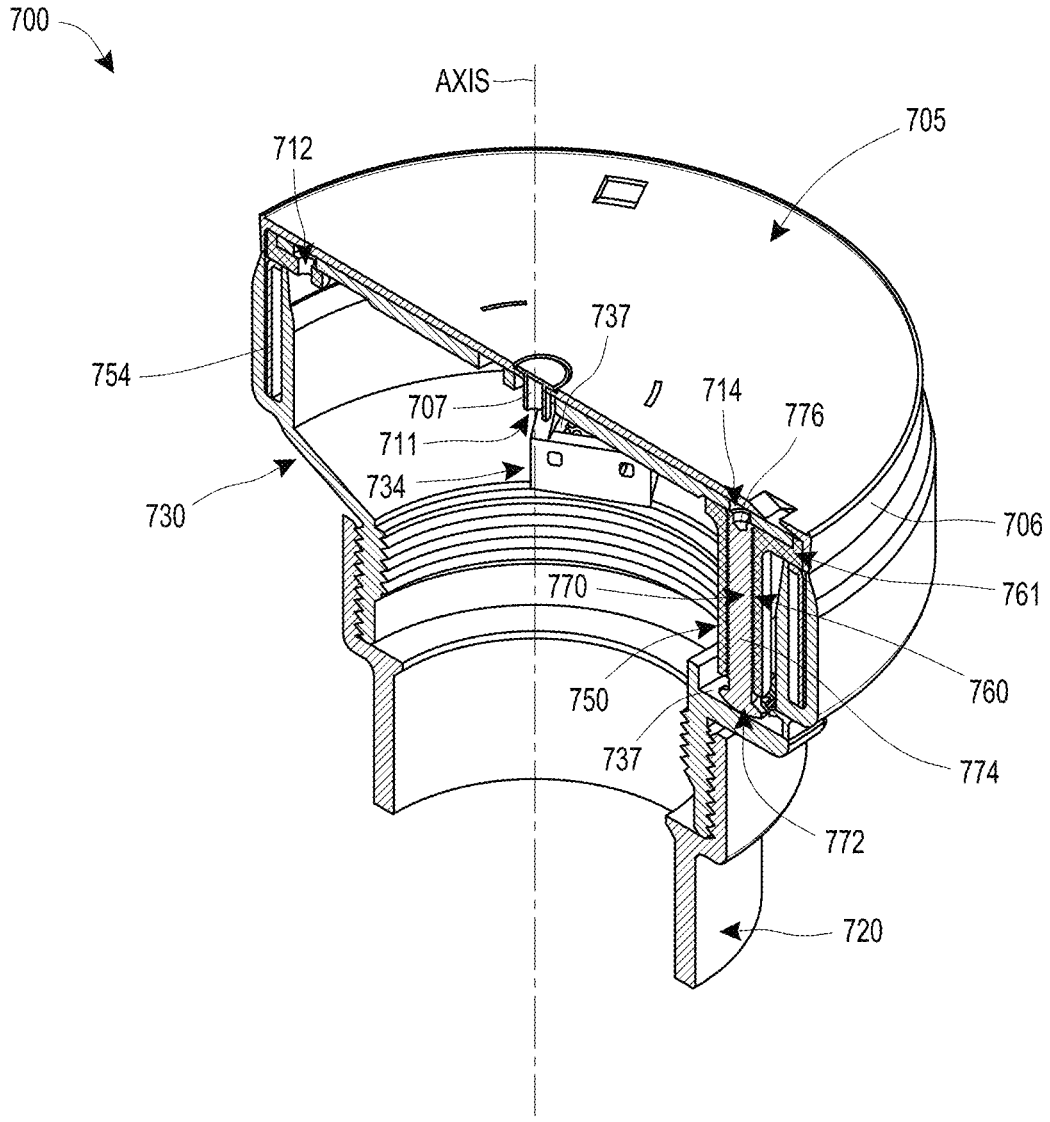
Figure 20C:
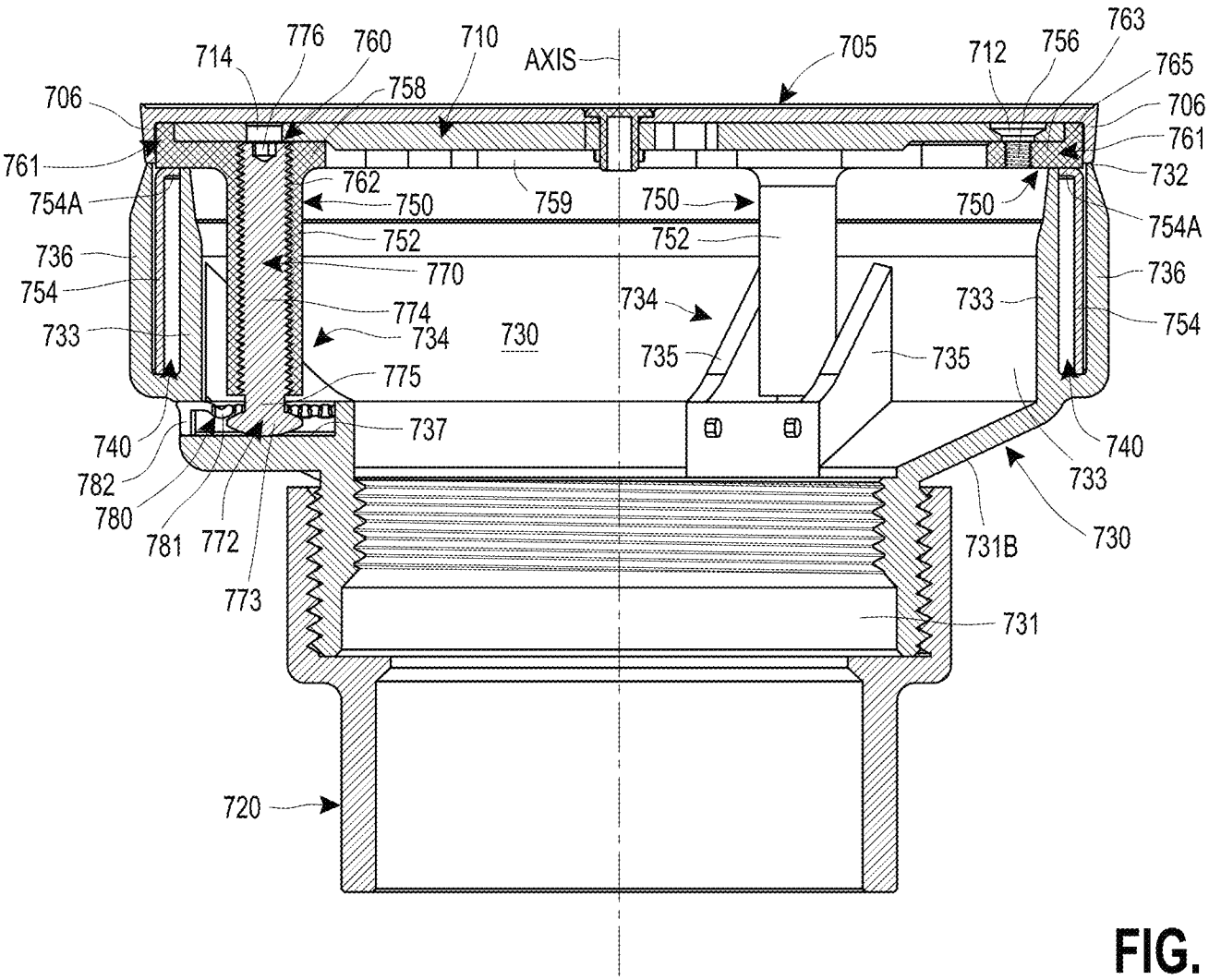

FIGS. 20A-20C are various views of another embodiment of an adjustable drain apparatus 700. FIG. 20A is a perspective view of the apparatus 700 and FIGS. 18B and 18C are cross-section views of the apparatus 700. In addition or alternatively to the description below, the apparatus 700 may be analogous to other drain apparatuses described herein, such as the apparatuses 100, 100', 100", 300, 400 and/or 500.

Referring to FIG. 20A, the apparatus 700 may include a cover 705 and a housing 730. The apparatus 700 may be assembled with a collar 720, such as hub pipe adapter. The cover 705 and housing 730 may be analogous to the cover 305 and housings 330 respectively. The cover 705 may include a lip 706, attachment 707, and openings 709, which may be analogous to the lip 306, attachment 307 and openings 309, respectively.

Referring to FIGS. 20B and 20C, the apparatus 700 may include a grate 710, the collar 720, the housing 730, a frame 550, and a holder 761 (which may be integral with the frame 750), which may be analogous to the grates 310, 410, the collars 320, 420, the housings 330, 430, the frames 350, 550, and the holders 361, 461 respectively. The grate 710 may include an opening 711 and attachment openings 712 and 714, which may be analogous to the openings 311, 411 and the attachment openings 312, 412 and 314, 414, respectively.

The collar 720 may include a cylindrical section with internal threads that provide an engagement feature for corresponding external threads of the housing 730. A lower cylindrical section of the collar 720 may couple with a drain pipe to fluidly connect the apparatus 700 with the pipe.

The apparatus 700 may include the housing 730, which may be analogous to the housing 330. The housing 730 may include a lower wall 731 and an inner upper wall 733, which may be analogous to the walls 331, 333. The lower and upper walls 731, 733 may be connected by an angled segment or portion 731B, which may be analogous to the portion 331B. The housing 730 may have a circumferential outer wall 736, e.g. cylindrical or generally cylindrical, that may be analogous to the outer wall 336. The housing 730 may include the outer wall 736 forming a reduced diameter section below an increased-diameter section, as shown. In some embodiments, the diameters may be the same or the relation reversed. The outer wall 736 may have an edge 732 and may be analogous to the outer walls 336, 436 having edges 332, 432. The outer wall 736 may include internal threads and/or external threads, such as at and/or near the bottom cylindrical section of the housing 730. The housing 730 may be adjustable, for example it may ride on the collar 720 by engaging the external threads of the housing 730 with the internal threads of the collar 720. The housing 730 may comprise therein a plurality of receiving areas 734, each receiving area having a bottom 737, which may be analogous to the receiving areas 334 and bottoms 337.

The apparatus 700 may include a leveling frame 750. The frame 750 may be analogous to other leveling frames described herein, such as the frames 50, 150, 250, 350, 450, and/or 550. The frame 750 may sit on top of the housing 730, either directly or with intermediate structures, fittings, etc. As the frame 750 is adjusted, the frame 750 may move relative to the housing 730.

The frame 750 may include one or more locking blocks 752, which may be analogous to other locking blocks described herein, such as the locking blocks 52, 152, 352 and/or 452. The locking blocks 752 may extend axially downward as oriented for a shorter, longer or similar length as compared to the locking blocks 352, 452. The locking blocks 752 may extend downward from the frame 750 as oriented when installed with the apparatus 700.

The frame 750 may include one or more internal flanges 758 and/or an inner ring 759, which may be analogous to the internal flanges 358, 458 and inner rings 359, 459, respectively. The locking blocks 752 may extend from corresponding flanges 758 of the frame 750. The ring 759 may include openings 756, which may be analogous to the openings 356, 456.

The frame 750 may include one or more actuation apertures 760 having internal threads 762. The actuation aperture 760 may be analogous to other actuations apertures described herein, such as the actuation aperture 60, 160, 260, 360, 460 and/or 560. The apertures 760 may receive a leveling member 770, as further described, which may engage with the threads 762.

The apparatus 700 may include a strain holder 761 having a flange 763, a lip 765 and openings 764, which may be analogous to the holders 361, 461 having the flanges 363, 463, lips 365, 465 and openings 364, 464, respectively. As shown, in some embodiments, the holder 761 may be integral with the frame 750.

The apparatus 700 may include one or more leveling members 770, which may be analogous to the leveling members 70, 170, 370, 470 and/or 570. The leveling member 770 may include a head 772 and shaft 774 with a tool receiving portion 776, which may be analogous to the other heads and shafts of leveling members described herein, for example the heads 72, 172, 372, 472, 572 and shafts 74, 174, 374, 474, 574 respectively. The head 772 of the leveling member 770 may include an end portion 773 and a middle portion 775, which may be analogous to the end portion 773 and middle portion 775. The space created by the differences in relative diameters of the end and middle portions 773, 775 and the lower end of the locking block 752 may receive a plate 780 therein, for preventing axially upward and/or downward movement of the leveling member 770. The plate 780 may be analogous to the plates 380, 480, 580. The plate 780 may have a central engagement portion 781 for engaging the leveling member 770. The plate 780 may have the central engagement portion 781 with a ridge 782, which may be annular, that extends from the central engagement portion 781 to the bottom 737 on which the plate 780 sits. The central engagement portion 781 may include a series of rounded tabs or elements to complement surfaces of the head 772 of the leveling member 770 with which the plate 780 engages to prevent movement. In some embodiments, the plates 780 may be inserted into the respective receiving area 734 either internally or externally. For example, the plates 780 may be inserted externally from the outside of the housing 730 through openings in the housing 730 and into the corresponding receiving area 734.

The apparatus 700 may include a shield or fin 754. The fin 754 may be a separate part of the apparatus 700, or it may be part of other components, such as part of the frame 750. The fin 754 may be analogous to other fins described herein, such as the fin 54, 354. The fin 754 may extend circumferentially about the axis and axially down into the channel 740 of the housing 730. The fin 754 may include a lip 754A. The lip 754A may be located at or near a top portion of the fin 754. The lip 754A may extend transversely to the fin 754, for example horizontally as shown. The lip 754A may provide a cover for the channel 740 to prevent debris from entering. The lip 754A may provide a support for other features of the apparatus 700, such as for the frame 750. In some embodiments, the holder 761 rests on the fin 754, such as on the lip 754A. The fin 754 may or may not be connected to the frame 750 or other features. In some embodiments, the fin 754 is connected to the frame 750 such that movement of the frame 750 creates corresponding movement of the fin 754. The housing channel 740 may be wider than all or portions of the fin 754 such that the fin 754 can be angled within the channel 740, for example as the frame 750 is adjusted and/or after the frame 750 is adjusted. In some embodiments, the lip 754A may limit the amount of any angling of the fin 754 within the channel 740.

The apparatus 700 may be assembled with a variety of approaches, such as those described herein with respect to assembly of the apparatuses 300, 400 and/or 500. The apparatus 700 may be adjusted by adjustment of the leveling members 770, for example similar to adjustment of the leveling members 372, 472, 572 as described with respect to the apparatuses 300, 400, 500. Thus the frame 750, and therefore the grate 710, may translate, rotate, etc. to a desired orientation by selective rotation of one or more of the leveling members 770.

The terms "approximately", "about", and "substantially" as used herein represent an amount or characteristic close to the stated amount or characteristic that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount or characteristic.

Although the foregoing description of the preferred embodiments has shown, described and pointed out the fundamental novel features of the inventions, it will be understood that various omissions, substitutions, and changes in the form of the detail of the apparatus as illustrated as well as the uses thereof, may be made by those skilled in the art, without departing from the spirit of the inventions.

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures or characteristics of any embodiment described above may be combined in any suitable manner, as would be apparent to one of ordinary skill in the art from this disclosure, in one or more embodiments.

Similarly, it should be appreciated that in the above description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A method of adjusting an adjustable floor drain apparatus, the method comprising:

rotating one or more leveling members of a plurality of leveling members;

axially moving one or more locking blocks in response to rotating the one or more leveling members; and tilting a grate in response to axially moving the one or more locking blocks;

wherein the floor drain apparatus further comprises a housing extending circumferentially about an axis and comprising therein a plurality of receiving areas, each receiving area having a floor, and the leveling members configured to extend into a respective receiving area with a wide portion of the leveling member axially restrained by a plate located above the floor.

2. The method of claim 1, wherein the floor drain apparatus further comprises a plurality of plates, with each plate secured within one of a plurality of receiving areas of a housing with at least a portion of the plate offset in an axial direction from a bottom portion of the receiving area, with each plate comprising a channel therethrough having a first width.

3. The method of claim 2, wherein the one or more leveling members each comprise a shaft having a head at a first end and a tool receiving portion at a second end, the shaft at least partially threaded, the head including an end portion having a second width greater than the first width, each shaft of the leveling members configured to threadingly engage threads of a vertical bore of the respective locking block with the end portion positioned between the bottom and the plate to axially secure the leveling member within the receiving area.

4. The method of claim 2, wherein a shaft of each leveling member threadingly engages threads of a vertical bore of a respective locking block with an end portion of the leveling member positioned between the bottom and the plate to axially secure the leveling member within the receiving area.

5. The method of claim 1, wherein the floor drain apparatus further comprises a leveling frame comprising a ring extending circumferentially about the axis, and wherein the one or more locking blocks extend downward from the ring, each of the one or more locking blocks comprising a vertical bore configured to align with a corresponding receiving area of the housing, the vertical bore at least partially threaded.

6. The method of claim 1, wherein the grate comprises a plurality of openings, each of the plurality of openings configured to be aligned with a threaded bore of a respective one of the one or more locking blocks.

7. The method of claim 1, wherein rotation of the leveling members adjusts the grate relative to a housing of the floor drain apparatus while the leveling members remain axially stationary relative to the housing.

8. A method of adjusting an adjustable floor drain apparatus, the method comprising:

actuating one or more leveling members of a first, second, and third leveling member to adjust an axial position of at least a portion of a grate relative to a housing while each leveling member remains axially fixed relative to the housing, wherein the housing defines an axis and is configured to be positioned adjacent a drain pipe, a leveling frame is positioned at least partially above the housing, the leveling frame is moveable relative to the housing, the grate is positioned at least partially above the leveling frame and secured to the leveling frame, and the first, second and third leveling members are coupled with the frame and axially restrained by the housing, with an end of each leveling member accessible through the grate to be actuated; and wherein the housing extends circumferentially about an axis and comprising therein a plurality of receiving areas, each receiving area having a floor, and the first, second and third leveling members configured to extend into a respective receiving area with a wide portion of the leveling member axially restrained by a plate located above the floor.

9. The method of claim 8, further comprising coupling the housing with the drain pipe via a collar.

10. The method of claim 8, further comprising actuating the first, second and third leveling members different amounts to angle the grate relative to the axis.

* * * * *